US005800050A

United States Patent [19]

Leadford

[11] Patent Number: 5,800,050

[45] Date of Patent: Sep. 1, 1998

[54] DOWNLIGHT AND DOWNLIGHT WALL WASH REFLECTORS

[75] Inventor: Kevin F. Leadford, Crawfordsville, Ind.

[73] Assignee: NSI Enterprises, Inc., Atlanta, Ga.

[21] Appl. No.: 610,434

[22] Filed: Mar. 4, 1996

[51] Int. Cl.[6] ..... F21V 7/00; F21S 1/02

[52] U.S. Cl. ..... 362/296; 362/297; 362/346; 362/347; 362/364; 362/148

[58] Field of Search ..... 362/297, 346, 362/260, 148, 364, 347, 349, 183, 296

[56] References Cited

U.S. PATENT DOCUMENTS

| | | | |
|---|---|---|---|
| 1,387,424 | 8/1921 | Merritt | 362/347 |
| 3,370,165 | 2/1968 | Chan | 362/364 |
| 4,039,822 | 8/1977 | Chan et al. | 362/183 |
| 4,475,147 | 10/1984 | Kristofek | 362/148 |
| 4,562,517 | 12/1985 | Pankin | 362/346 |
| 4,742,440 | 5/1988 | Guzzini | 362/346 |
| 5,363,295 | 11/1994 | DeKleine et al. | 362/346 |
| 5,398,179 | 3/1995 | Pacheco | 362/364 |
| 5,440,471 | 8/1995 | Zadeh | 362/364 |
| 5,535,110 | 7/1996 | Ling | 362/297 |

OTHER PUBLICATIONS

QUICKLITE, The Fast Permanent Retrofit Ceiling Fixture for Recessed Downlights, Lighten Up Products, see entire document. Apr. 1995.

*Primary Examiner*—Ira S. Lazarus
*Assistant Examiner*—Matthew Spark
*Attorney, Agent, or Firm*—Kenneth E. Darnell

[57] ABSTRACT

Downlight and downlight wall wash reflectors particularly useful with compact fluorescent lamps and other large-area light sources, the reflector optics of the invention maximize the efficiency of the luminaire while providing brightness control and avoidance of high angle glare or "flash". Downlight reflectors according to the invention provide a truly uniform illuminance distribution across the illuminated area when applied in a rectangular grid with maximum use of available light by providing an upper amplifying reflector section which reflects normally underutilized light to a lower distribution reflector section which radiates a large percentage of generated light effectively from the bottom of the light source, thus reducing the apparent size of the light source and increasing optical control. The lower reflector section reflects light only into zones where the light is needed and avoids high angle zones, most of the light being reflected into zones from 35° to 45° from vertical or nadir, thereby widening the distribution and also producing high efficiency and aesthetically pleasing performance. Wall wash reflectors according to the invention are provided with a specular lower zone formed by a specular finish at lower portions of the wall washing reflectors to yield high light levels on a vertical wall near the ceiling line while avoiding high angle glare or "flash" in the opposite direction.

64 Claims, 15 Drawing Sheets

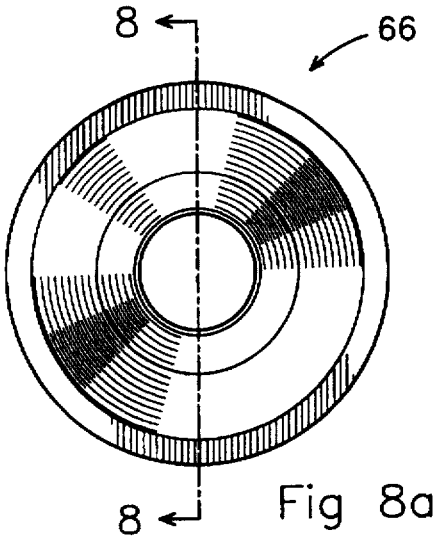
Fig 8a
Fig 8b
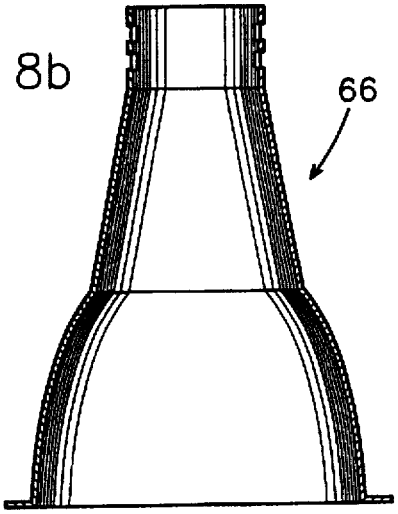
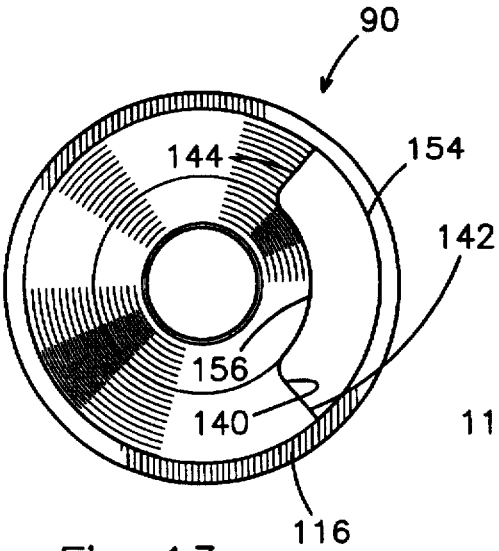
Fig 13a
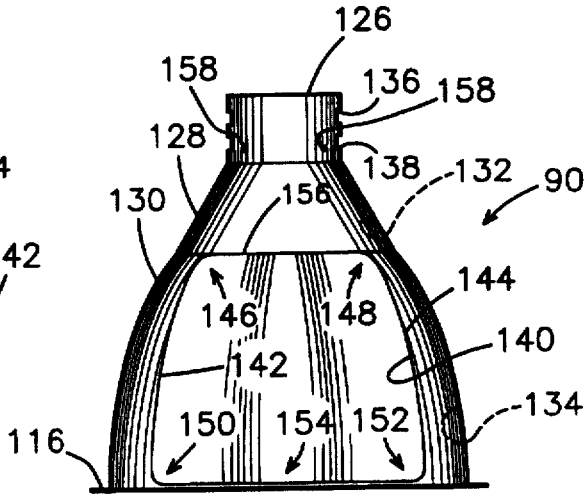
Fig 13b $D_A$ = Aperture Diameter (4" – 12")
$D_N$ = Neck Diameter (1" – 3")
$\theta_{S1}$ = Right Side Shield Angle (325° – 315°)
= 360 deg – Shield Angle (Conventional)
$\theta_{S2}$ = Left Side Shield Angle (215° – 225°)
= 180 deg + Shield Angle (Conventional)

$\theta_H$ =Higher Bounding Angle of ith segment
$=(\theta_{S1}+\frac{(\theta_{S2}-\theta_{S1}+180)i)}{n}$ $\theta_C$ =Left Side Cutoff Angle (217–277)
$=\theta_{S1}+2°$ $\theta_H$ =Higher Bounding Angle of ith segment $$=\left(\theta_{S1}+\frac{(\theta_{S2}-\theta_{S1}+180)i}{n}\right)$$

$\theta_{Ki}$ =Reflection Angle of ith segment

DOWNLIGHT AND DOWNLIGHT WALL WASH REFLECTORS

BACKGROUND OF THE INVENTION

1. Field of the Invention

The invention relates generally to downlight and downlight wall wash or "kicker" reflectors and particularly to such reflectors used with large-area light sources such as compact fluorescent lamps.

2. Description of the Prior Art

Downlighting has long been provided utilizing recessed lighting fixtures having incandescent lamping as the source of light. Since downlighting was essentially developed using incandescent light sources, the design of downlighting fixtures over the years evolved to include reflector structure particularly intended for use with incandescent light sources. These prior reflectors at least at specification grade levels were developed to provide optimum flash cutoff so that glare from incandescent downlighting fixtures was held to a relatively comfortable minimum. Unfortunately, incandescent light sources are wasteful of energy relative to fluorescent light sources and other technologies which now compete for inclusion in downlighting applications. Relatively more recently, the development of compact fluorescent light sources has provided new opportunities for energy efficiency in downlighting applications. Power consumption is tremendously reduced with the compact fluorescent light sources relative to incandescent lamping. In most downlighting applications, the lower light levels encountered with compact fluorescent lighting sources is relatively insignificant since downlighting is not typically used as a primary source of task lighting in downlighting applications. Downlighting is ordinarily provided in hallways, lobbies, conference rooms, etc. where high light levels are not necessary, such environmental spaces normally having an IES classification as Category D which applies to areas where the performance of visual tasks of high contrast or large size are performed. However, due to the relatively lower light levels provided by compact fluorescent lighting sources relative to incandescent and others, it is absolutely essential to maximize utilization of that light which is generated by the compact fluorescent light source.

Compact fluorescent light sources have been available for at least ten years. The availability of the first PL compact fluorescent lamp manufactured by Philips quickly resulted in the availability of compact fluorescent downlighting fixtures having performance based more on compromise than intelligent design. These first compact fluorescent lamps were unthinkingly inserted into standard incandescent reflectors. Since these first compact fluorescent lamps were longer than standard incandescent lamps, the distal portion of the compact fluorescent lamp often extended beneath the ceiling line and resulted in unacceptable brightness at high angles. These first compact fluorescent lamps also delivered unacceptable light levels relative to standard incandescent lamps. The continuing evolution of compact fluorescent downlighting fixtures continued the original compromise inherent in a choice between energy efficiency and aesthetically pleasing lighting. Higher light levels were produced by compact fluorescent downlighting fixtures using two horizontally disposed lamps rather than one vertical lamp. However, these horizontally lamped fixtures were relatively inefficient and the fixtures themselves generally lacked pleasing appearance. In these fixtures, nearly half of the light produced by the compact fluorescent lamps was radiated to the top of the fixture where optical control is restricted such that much of the generated light was not fully utilized. The effective lumens available at the sides of reflectors used with these fixtures was not fully utilized since the contour of the reflector was typically designed with a point source assumption when two compact fluorescent lamps actually constitute a large-area source with complex geometry. The horizontal compact fluorescent downlighting fixtures were also characterized by poor aperture performance, the lamp image often being viewed at uncomfortably high angles, the lamp image further being distracting at all viewing angles where the image exists. The non-uniform lamp image thus produced revealed itself on walls or other close surfaces as inconsistent scallops often marred with striations. The horizontally lamped fixtures of the prior art also fail to provide for the tempermental thermal nature of compact fluorescent lamps. Since compact fluorescent lamps are sensitive to changes in ambient temperature and operate at peak output over a relatively narrow range, the horizontally disposed lamps in prior downlighting fixtures generated fewer lumens than desired since the horizontal lamps inside the fixture reflector operated at ambient temperatures which were well outside the optimum range for operation of compact fluorescent lamps. While design evolution included ventilation of horizontally lamped compact fluorescent downlighting fixtures to provide acceptable fixture efficiencies and brightness control, prior fixtures including those properly ventilated offer shortcomings such as inconsistent "flash" which reduces the utilization of such fixtures in specification grade downlighting environments. Other problems associated with even properly ventilated horizontally lamped fixtures include the necessity to increase aperture sizes in order to gain desired performance. Further, less than optimal lamp orientation causes these fixtures to lack the aesthetic appeal of incandescent downlighting. Energy efficiency in these prior structures could not be obtained without compromising aesthetics.

Patents relating to reflectors used with compact fluorescent lamps include U.S. Pat. No. 5,363,295 to DeKleine et al, this patent disclosing a reflector useful with an elongated compact fluorescent lamp having a plurality of parallel tubes elongated along an axis. The DeKleine et al reflector provides an annual reflecting inner surface surrounding the parallel tubes of the lamp, the inner surface of the reflector including at least one surface defined by a geometric curve rotated at least partially about a given axis with the curve having a focal point which is laterally offset from the given axis in order to produce a focal ring segment for enhancement of light emitted by the surface of the compact fluorescent lamp. Multiple surface segments are defined by an axis offset from the lamp axis of elongation and spaced radially around the compact fluorescent lamp, these segments being positioned at major lumen output lobes of the lamp. The DeKleine et al reflector can be utilized in a recessed lighting fixture both with and without a lens.

Wall wash downlighting reflectors have also been developed with incandescent light sources with structural features of such wall wash reflectors accommodating the characteristics of incandescent lamps. Patents relating to wall wash reflectors include U.S. Pat. No. 4,475,147 to Kristofek who provides a ceiling mounted, recessed downlighting fixture capable of producing a wall washing effect by positioning of an auxiliary reflector within the confines of a conventional downlighting reflector. Guzzini, in U.S. Pat. No. 4,742,440 describes a reflector having wall washing capability and comprised of a main conical reflector provided with an opening in a side wall thereof with an additional reflector segment being externally mounted relative to the opening. In the Guzzini reflector, the additional reflector segment is held in spaced relation to the opening.

The prior art continues to exhibit a need for a downlighting fixture including a downlighting fixture capable of wall wash and with energy efficiency such as can be provided through the use of compact fluorescent lamping and which further provides the aesthetic acceptability of downlighting fixtures provided with incandescent A-lamp sources as an example. Further, the art continues to show a need for the efficient use of compact fluorescent light sources in downlighting. The present invention provides reflector structures for both ordinary downlighting and wall wash applications and which are particularly useful with compact fluorescent lamps and other large-area light sources to maximize the efficiency of the lumenaire while providing brightness control and avoiding high angle glare or "flash". The reflectors of the invention allow design of downlighting fixtures such as recessed fixtures and the like which are of specification grade due to the capability thereof to provide aesthetics normally associated only with incandescent downlighting.

SUMMARY OF THE INVENTION

The invention provides downlight and downlight wall wash lighting fixtures having reflectors which enable the fixtures to rival in aesthetic performance the best available incandescent downlight and downlight wall wash lighting fixtures and with energy efficiencies brought about through the use of compact fluorescent lamps as light sources. While the present reflectors are particularly intended for use with energy-saving compact fluorescent lamps, it is to be understood that the reflectors can be used to maximize the effective light efficiency of other large-area light sources by causing a high percentage of the light generated by such sources to be usefully distributed by the fixture. In addition to energy efficiency and utilization of a high percentage of light generated by the light source, the reflectors of the present invention provide an aperture appearance which is nearly identical to that of incandescent light sources in downlighting situations. The reflectors essentially eliminate "flash", that is, the reflectors function to provide low aperture brightness at high angles, thereby eliminating the visual discomfort associated with unwanted glare as is often produced by poorly designed reflectors such as are often used in downlighting fixtures. The downlight reflectors of the invention produce a smooth single scallop on vertical surfaces. The present downlight reflectors can further produce effective wall wash by utilization of a kicker reflector.

The present invention is particularly embodied in reflector structures which are designed to treat a compact fluorescent light source as a large-area light source rather than as a point light source. The downlight reflectors of the invention include a body element mountable to a ventilated, die-cast aluminum socket housing, the housing also mounting one or more thermoplastic sockets which receive a compact fluorescent light source such as twin-tube, double twin-tube, tri-tube lamps inter alia. The reflectors of the invention are formed of aluminum anodized after reflector formation and polishing to a sufficient wall thickness to allow the reflector to be effectively used as a housing for the light source, the reflector being mounted by a pan or frame which then mounts within a ceiling such as between joists or to a suspended ceiling. The pan or frame also mounts a junction box and a ballast preferably mounted to the junction box for operation of the light source. While the reflectors of the invention may be utilized with lens structures, the primary utility of the reflectors is their use as "open" reflectors. The lighting fixtures formed with the present reflectors as primary structural features are particularly useful as recessed lighting fixtures which mount within an opening in a ceiling or the like. The reflectors intended for downlight use are provided with an annular flange which functions as a trim about the ceiling opening through which the lighting fixture directs light. A reflector according to the invention is provided with a body having an uppermost light source mounting portion which is generally cylindrical in shape and provided with slots intended for use with prior art locking structure for mounting a light source within the confines of the reflector, the cylindrical portion thus described surmounting a light amplification reflector section which reflects normally under-utilized light to a lower distribution reflector section surmounted by the amplifier section. The upper and lower sections have reflecting inner wall surfaces which are essentially specular and which are optical surfaces such as are formed by anodized aluminum. The distribution section has an inner surface defined by a geometric curve rotated about a given axis which is generally parallel to the axis of elongation of the light source, the reflective surface thus generated being designed for precise brightness control, high efficiency and broad distributions. The optical design of the highly specular inner surface of the reflector produces an aperture appearance which is similar to the appearance of prior incandescent luminaires used in downlighting situations. The anodized surface of the reflector also acts to suppress irridescence.

Wall wash reflectors according to the invention also eliminate "back flash" while producing high, smooth light levels at and near the ceiling line. The wall wash reflectors of the invention are provided with a kicker reflector which is spaced from an opening formed in the primary wall wash reflector, the kicker reflector preferably having a specular lower zone formed thereon by virtue of treatment including polishing which produces a highly specular finish at the lower zone of the kicker reflector, this highly specular finish feathering into the remaining upper portions of the kicker reflector having a semi-specular finish. High light uniformity on a vertical wall is thereby provided through use of the present wall washing reflector structures.

Accordingly, it is a primary object of the invention to provide downlight and downlight wall wash reflectors which are particularly useful with compact fluorescent lamps and other large-area light sources for maximizing light source efficiency while providing brightness control and avoidance of high angle glare or "flash".

It is another object of the present invention to provide downlight reflectors which provide uniform illuminance distribution across an illuminated area while maximizing the use of available light generated by a compact fluorescent or other large-area light source, thereby to reflect normally under-utilized light to a portion of the reflector which distributes a large percentage of generated light effectively from the bottom of the lamping.

A further object of the invention is to provide a downlight fixture utilizing a compact fluorescent or similar lamp as the light source, an electronic ballast for efficient operation of the light source and a reflector for maximizing light output while offering aesthetic values comparable to incandescent downlighting of specification grade quality.

Further objects and advantages of the invention will become more readily apparent in light of the following detailed description of the preferred embodiments.

BRIEF DESCRIPTION OF THE DRAWINGS

FIG. 8A is a plan view of a still further embodiment of the reflector of the invention;

FIG. 8B is a section of the reflector of FIG. 8A taken along lines 8—8;

FIG. 13A is a plan view of a primary reflector body formed to cooperate with a kicker reflector to form a wall wash reflector according to the invention;

FIG. 13B is a side elevational view of the structure of FIG. 13A;

DESCRIPTION OF THE PREFERRED EMBODIMENTS

Figure 1:
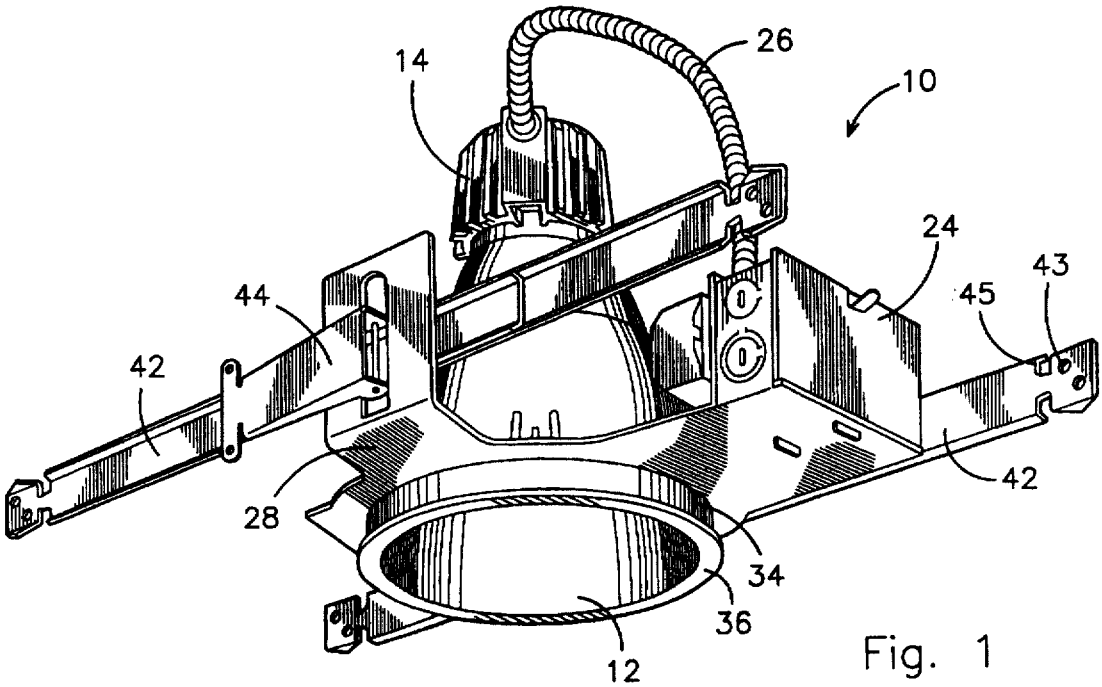
FIG. 1 is a perspective view of a downlight lighting fixture having a reflector according to the invention.
Figure 2:
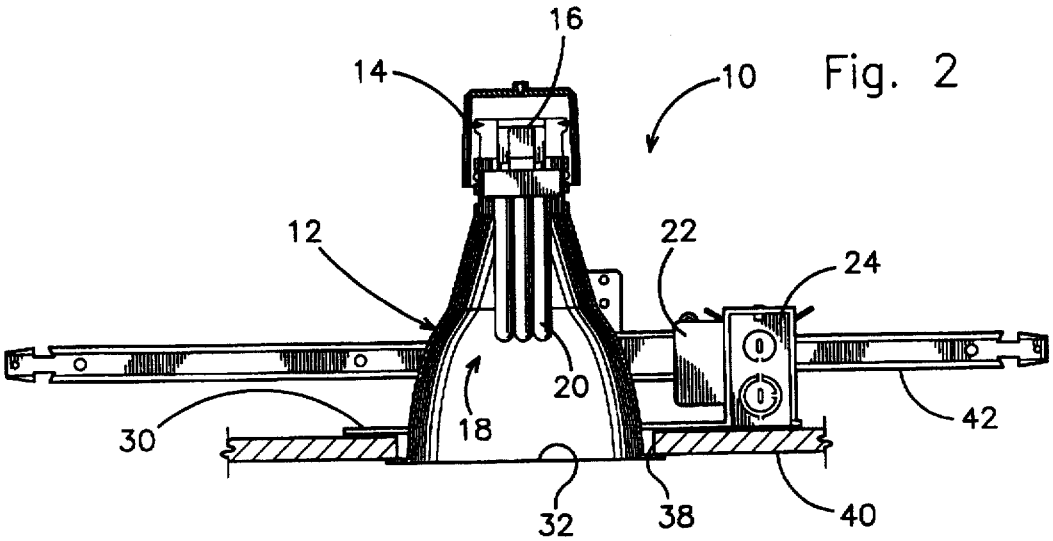
FIG. 2 is an idealized elevational view of the fixture of FIG. 1 mounted in a ceiling in a use environment and utilizing a compact fluorescent tri-tube lamp.

Referring now to the drawings and particularly to FIGS. 1 and 2, a downlight fixture is seen at 10 to comprise as its primary feature a reflector 12. A die-cast aluminum socket housing 14 fits onto the upper end of the reflector 12, the housing having a thermoplastic socket 16 mounted therein for receiving a compact fluorescent lamp 18. The base of the compact fluorescent lamp 18 mounts into the socket 16 with tubes 20 of the lamp 18 extending downwardly into the interior of the reflector 12 when in an operational position. The lamp 18 is driven by a rapid start electronic ballast 22 which mounts to junction box 24 on either side of said box 24. The junction box 24 conventionally connects electrically to a mains power source which provides power to the assembly thus described. The ballast 22 joins to the socket housing 14 by means of a shielded conduit 26 which carries conductors (not shown) which connect to the socket 16 to provide power to the lamp 18 in a conventional manner.

The thermoplastic socket 16 is also conventional in the art and preferably takes the form of a vertically-mounted, four-pin, positive-latch socket structure. The ballast 22 is also conventional in the art and comprises a Class P high frequency solid-state ballast which is thermally protected and mounts as aforesaid to the junction box 24. The ballast 22 is chosen to have a capability for operation of multiple wattage lamps. The junction box 24 is preferably formed of galvanized steel with bottom-hinged access covers and spring latches although the junction box 24 can take many forms without departing from the scope of the invention since the junction box 24 is essentially conventional in the art. The junction box 24 is preferably formed with various knockout arrangements which allow straight-through conduit runs and the like. The junction box 24 typically has a capacity of eight No. 12 AWG conductors (not shown) and is rated for 75° C.

The structure thus described as comprising the downlight fixture 10 is mounted to a mounting pan or mounting frame 28 as is conventionally formed of 16-gauge galvanized steel, the frame 28 having friction support springs 30 which act to hold the reflector 12 within opening 32 formed in the frame 28. The opening 32 in the frame 28 is essentially defined by a vertically extending annular flange 34 which extends downwardly from major planar portions of the frame 28. The reflector 12 is inserted into the opening 32 from the bottom thereof, the springs 30 disposed about the opening 32 and being mounted on the flange 34 acting to engage the reflector 12 and hold the reflector 12 within the opening 32 at full extension of said reflector 12 into the opening 32. The reflector 12 is formed with a laterally extending annular flange 36, upper surface portions of the flange 36 adjacent to the body of the reflector 12 abutting against lowermost perimetric edge portions of the flange 34 on full insertion of the reflector 12 into the opening 32. As is seen in FIG. 2, an opening 38 formed in a ceiling 40 receives lower portions of the reflector 12 thereinto, the flange 34 of the frame 28 being juxtaposed from side walls of the ceiling opening 38 while the flange 36 of the reflector 12 provides a trim piece which covers perimetric edges of the ceiling opening 38 and provides an attractive finish.

The mounting frame 28 is provided with expandable pairs of mounting bars 42 on each side of said frame 28 for mounting of the fixture 10 into a ceiling 40 or the like. The mounting bars 42 are conventional in the art and can comprise other mounting structure than as is shown in the drawings. The mounting bars 42 are provided with a locking mechanism 44 which is readily graspable to open the mechanism to allow sliding movement between bar elements of each pair of the mounting bars 42, the locking mechanism 44 being readily and rapidly closed once a desired horizontal adjustment is made. The locking mechanism further allows vertical adjustment of each pair of the mounting bars 42. The ends of each bar element of each pair of the mounting bars 42 are provided with conventional structure which facilitates attachment of the ends of each pair of the mounting bars 42 to joists or to track elements (not shown) of a suspended ceiling as is conventional in the art. The ends of the mounting bars 42, for example, can be provided with apertures 43 which receive screws (not shown) for mounting purposes or can be formed with nailing plates (not shown) or the like for attachment to wooden joists. Hanger elements 45 such as conventional T hanger elements can be provided on the ends of the mounting bars 42 for mounting to a suspended ceiling in a conventional manner.

The lamp 18 particularly comprises a compact fluorescent lighting source due in part to the substantial energy saving advantages of such lamps. A lamp known as a tri-tube lamp is particularly favored, such a lamp being produced by Philips and Osram/Sylvania. A typical tri-tube lamp has particularly favorable dimensions, the maximum overall length of a 32 W Philips tri-tube lamp being 5.5" which is substantially shorter than standard 26 W quad-tube lamps. The 26 W tri-tube lamp has a maximum overall length of 4.9" which is also favorable for use in a downlighting environment as a part of the downlight fixture 10. Even though extremely compact, the tri-tube lamps exhibit high efficiency along with benefits typically associated with compact fluorescent lamps, that is, long lamp life, high color-rendering index and choice of color temperature. While tri-tube lamps are preferred for use with the reflector 12 and the other reflectors falling within the scope of the present invention, it is to be understood that other compact fluorescent lamps and other large-area light sources can be utilized according to the invention. The tri-tube lamp, in particular, provides ease of optical control due to the compact nature of the lamp in addition to producing a greater amount of light with less energy even in light of the smaller size of the lamp. Various other advantages obtain from the use of tri-tube lamps due to various technologies employed in manufacture of such lamps. As an example, at least certain compact fluorescent tri-tube lamps overcome the temperamental thermal behavior which is characteristic of many compact fluorescent lamps, such behavior leading in most prior lamping structures to the generation of fewer lumens than would be expected due to the difficulty of operating such lamps within an appropriate and fairly narrow thermal range.

The electronic ballast 22 used to drive the compact fluorescent lamp 18 provides substantial advantages to operation of the downlight fixture 10, among these advantages being the absence of "flicker" and instant start. Since the ballast 22 is chosen to have a ballast factor of greater than 1, the lamp 18 can be run efficiently with the ballast 22 exhibiting low ballast loss.

The use of compact fluorescent lamping such as the lamp 18 in a downlighting environment has previously suffered from disadvantages which are essentially overcome by the optical design of the reflector 12. Due to these prior disadvantages, incandescent lamping in downlighting applications, particularly specification grade downlighting applications, has been preferred in spite of energy inefficiencies and relatively short lamp life due to the lack of glare or "flash" in well-designed incandescent downlighting fixtures. Prior compact fluorescent downlighting fixtures have often produced an aperture appearance which is objectionable due to glare or "flash" and due to high aperture brightness at high angles. Prior compact fluorescent downlighting fixtures rendered poor lighting images on walls or other close surfaces since such lighting exhibited inconsistent scallops of light which are marred with striations. The appearance of prior compact fluorescent downlighting has thus been characterized by shortcomings in aesthetic values. The face of the compact fluorescent lamp being a large-area source also leads to difficulties in optical control. The reflector 12 provides an optical design which allows effective use of large-area light sources such as the compact fluorescent lamp 18 and particularly the tri-tube lamp. In essence, the optical design of the reflector 12 and of the other reflecting structures according to the invention acts to decrease the effective size of the light source in order to provide greater optical control. Even though the tri-tube lamp is substantially smaller than prior compact fluorescent lamping, the tri-tube lamp remains a large-area light source.

The reflector 12 of the invention causes a substantially greater percentage of the light generated by the light source to be directed as usable light from a downlight fixture. The previously objectionable feature of difficult optical control as experienced with compact fluorescent lamping is essentially overcome through the optical design of the reflector 12. Light from upper portions of the lamp 18 as seen best in FIG. 3 for illustrative purposes is caused to be reflected to lowermost parts of the lamp 18, thereby resulting in a luminance or brightness at the tip or lowermost portion of the lamp 18 which is significantly increased. The light at the tip of the lamp 18 is then radiated from the bottom of the lamp, thereby reducing the apparent size of the light source and increasing optical control. Light is then reflected from lower portions of the reflector 12 into zones only where it is needed. By avoiding high angles due to the structure of the reflector 12, light distribution is widened. Due to the structure of the reflector 12, most light is reflected into zones from 35° to 45°, thereby providing high uniformity of illumination. The lamp 18 essentially becomes a "transformed" source by virtue of light being reflected to the lower portions thereof, that is, the tip, thereby producing a more luminous lamp image at high angles. When the image of the light source reflects in lower portions of the reflector 12, the reflection is smooth. Accordingly, aperture performance is essentially equal in aesthetics to the aperture performance of incandescent downlighting structures.

Referring again to FIG. 3, the reflector 12 used in the downlight fixture 10 of FIGS. 1 and 2 is seen. The reflector 12 is dimensioned to be used with a compact fluorescent lamp 18 which is taken to be a tri-tube lamp, the reflector 12 having an aperture diameter of 8". Reflectors according to the invention such as the reflector 12 will have the same general shape but with differing dimensions including differing dimensions and angular relationships of the major portions of the reflectors. While the optical geometry of the reflector 12 could be used in a reflector structure wherein the reflector 12 does not constitute the lamp housing as occurs with the reflector 12 within the downlight fixture 10, the reflector 12 of FIG. 3 as well as the other downlight reflectors described herein is intended to function as a housing for the compact fluorescent lamp 18. As one alternative, the geometry of the interior walls of the reflector 12 could be formed in inner walls of other housing structure including such housing structure as would not require mounting of the lamp 18 by structure forming internal reflector surfaces. The reflective surfaces of the reflector 12 could be formed on structure which is then mounted within a housing exterior to a reflector either with or without the necessity for directly mounting one of the compact fluorescent lamps 18 directly to a reflector such as the reflector 12. Given the present disclosure, it is to be understood that the primary features of the invention constitute the particular internal reflective surfaces of a reflector such as the reflector 12 regardless of the external geometry of said reflector.

Figure 3:
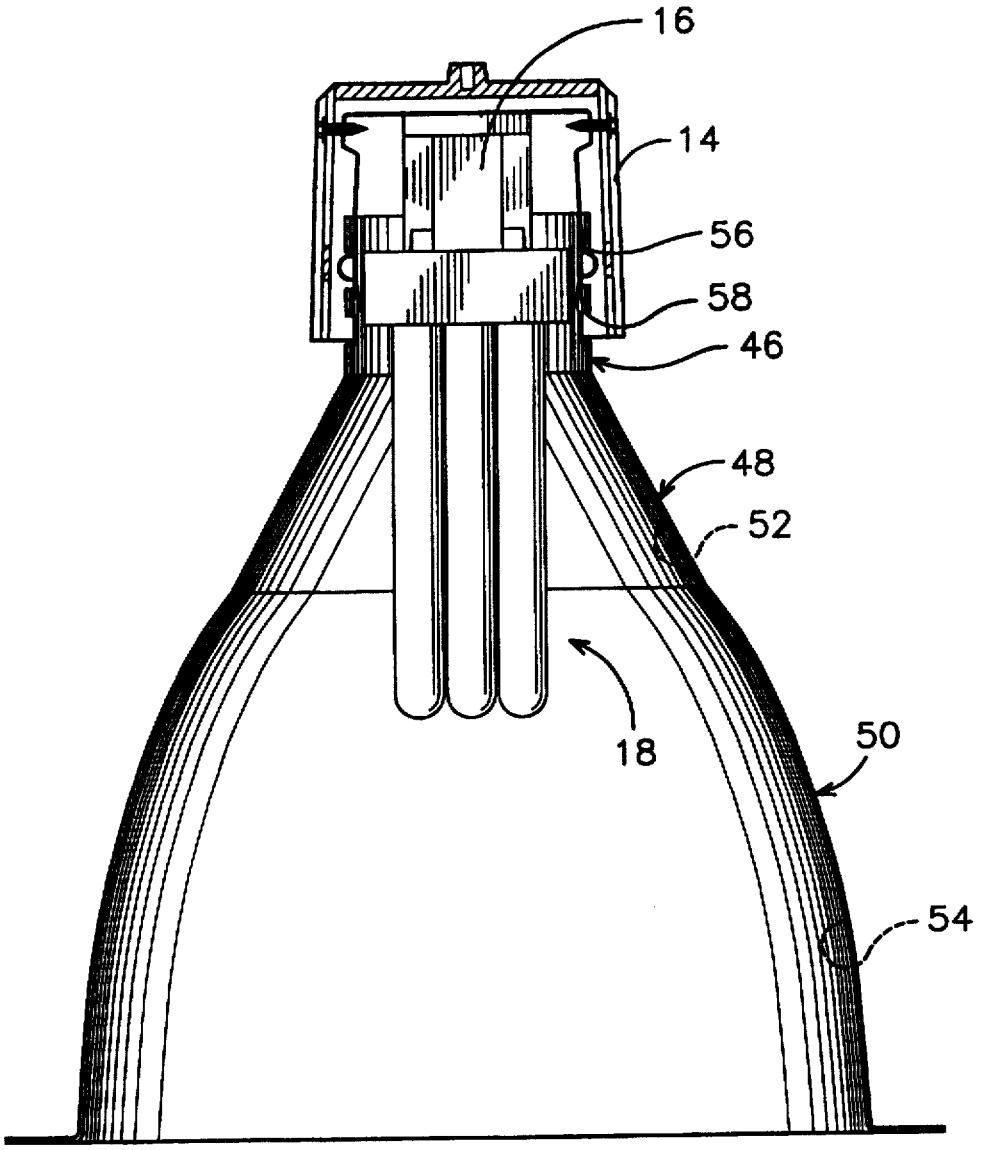
FIG. 3 is an idealized elevational view of the reflector and light source used in the assemblies of FIGS. 1 and 2.
Figure 4A:
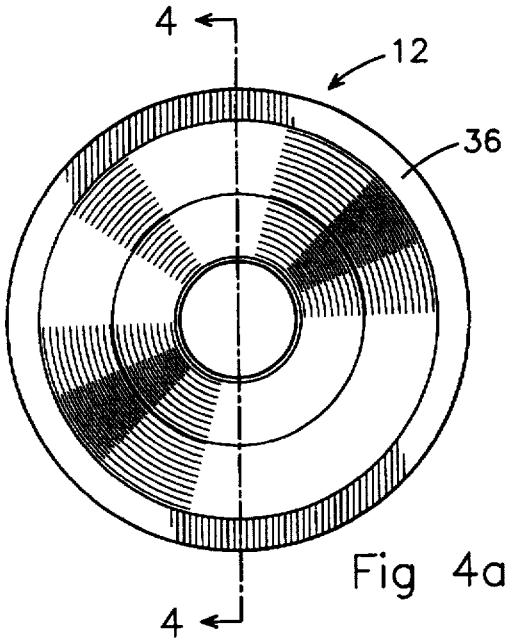
FIG. 4A is a plan view of the reflector of FIG. 3.

As is seen in FIG. 3 and also in FIGS. 4A, B and C, as well as at least partially in FIGS. 1 and 2, the reflector 12 comprises a cylindrical lamp support section 46 which essentially functions as a mechanical expedient for receiving the socket housing 14 thereover and thus housing the socket 16 and socket portions of the compact fluorescent lamp 18 therewithin, the tubes 20 of the lamp 18 extending downwardly from the support section 46 and into and usually through a light concentration section 48 which is frustoconical in conformation. The function of the light concentration section 48 will be described in more detail hereinafter. The light concentration section 48 surmounts light distribution section 50 which can generally be described as a macrofocal paraboloid generated by a curve of rotation formed of macrofocal parabola. The curve so generated, as will be described hereinafter, is rotated about the center line of the reflector 12 to generate the reflective surface of the light distribution section 50. The entirety of the reflector 12 can be formed of anodized aluminum, the aluminum being anodized according to the Alzak process, Alzak being a registered trademark of Alcoa. It is to be understood that other materials can be employed to form the reflector 12 given the ability of such materials to function to provide the desired performance. The respective internal reflective surfaces 52 and 54 of the sections 48 and 50 are the products of polishing and controlled anodizing and are therefore specular in nature, the anodized coating also suppressing irridescence. The optical geometry of the internal reflective surfaces 52 and 54 function respectively to concentrate light within the light concentration section 48 and deliver this concentrated light to the light distribution section 50 wherein the internal reflective surfaces 54 act to provide aesthetically pleasing appearance from typical viewing angles while spreading light smoothly into a broad beam. In essence, the internal reflective surfaces 54 provide optimum cutoff to lamp and lamp image and therefore reduce or essentially eliminate glare and the "flash" which results from poorly designed optical configurations in downlighting fixtures. The light distribution section 50 is seen to terminate with the laterally extending annular flange 36 described above. The various sections 46, 48 and 50 as well as the flange 36 of the reflector 12 can be conveniently formed as a unitary structure not only to cause the internal reflective surfaces 52 and 54 to be appropriately positioned relative to each other but also to provide sufficient structural integrity to the reflector 12 such that the reflector 12 can function also as a mounting for the socket housing 14 as well as a housing for the compact fluorescent lamp 18. As is best seen in FIGS. 2 and 3, lowermost portions, that is, the "tip" of the compact fluorescent lamp 18 is seen to extend into upper portions of the light distribution section 50.

The lamp support section 46 of the reflector 12 is seen to be provided with diametrically opposed pairs of upper and lower slots 56 and 58. The upper slots 56 are intended to facilitate mounting of a 32 W tri-tube lamp, a 26 W double twin-tube lamp or a 13 W twin-tube lamp. The lower slots 58 are intended to facilitate mounting of a 26 W tri-tube lamp, an 18 W double twin-tube lamp, a 13 W double twin-tube lamp, or a 9 W twin-tube lamp depending upon the choice of lamp which is useful with a reflector such as the reflector 12 of appropriate dimension.

Figure 4B:
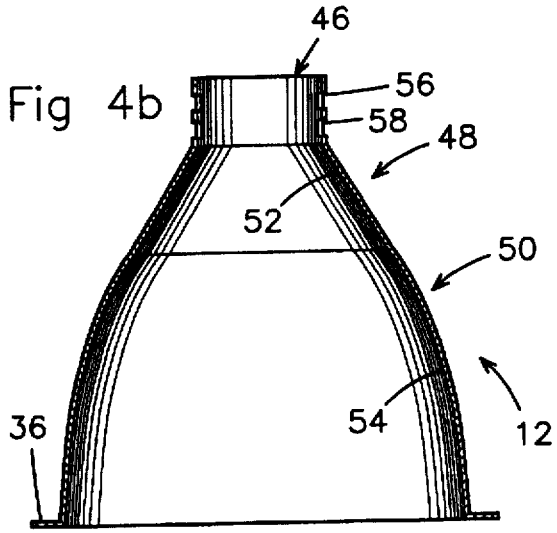
FIG. 4B is a sectional view of the reflector of FIG. 4A taken along lines 4—4.
Figure 4C:
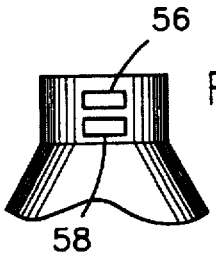
FIG. 4C is a detailed view of the slot arrangement formed in an upper portion of the reflector.
Figure 5A:
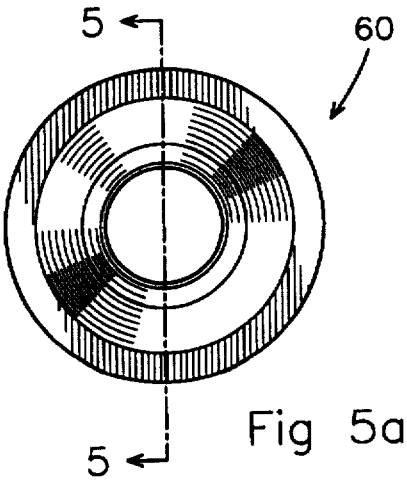
FIG. 5A is a plan view of another downlight reflector formed according to the invention.
Figure 5B:
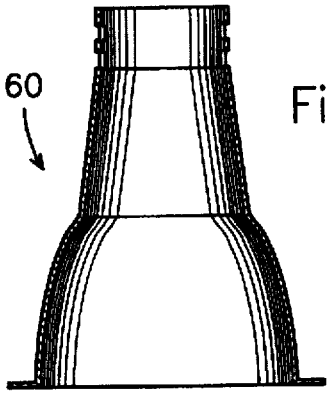
FIG. 5B is a section of the reflector of FIG. 5A taken along lines 5—5.
Figure 6A:
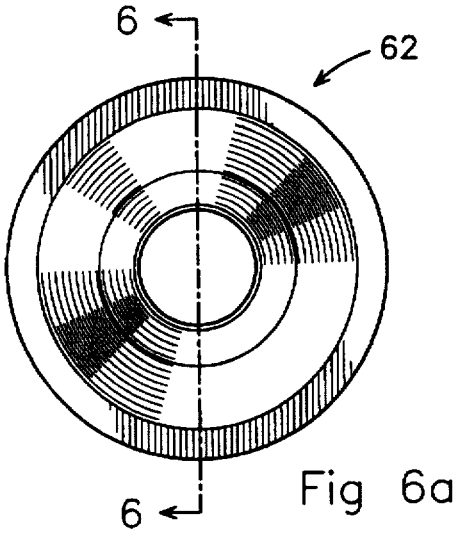
FIG. 6A is a plan view of a further embodiment of the reflector of the invention.
Figure 6B:
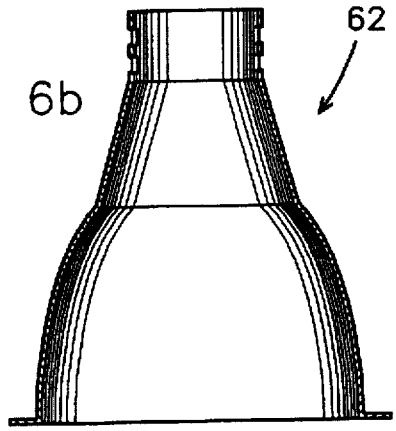
FIG. 6B is a section of the reflector of FIG. 6A taken along lines 6—6.
Figure 7A:
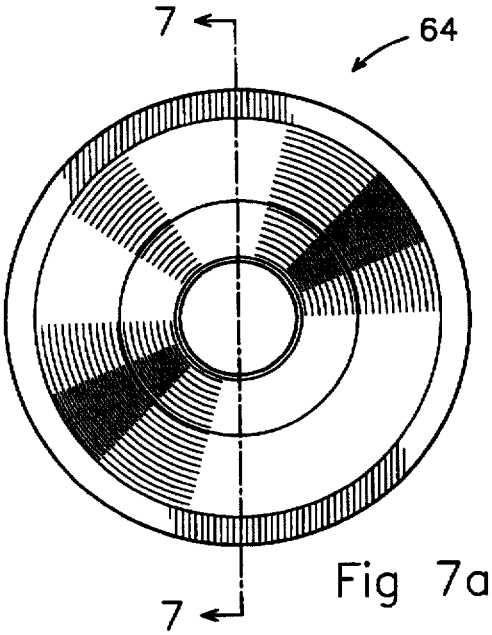
FIG. 7A is a plan view of yet another embodiment of the reflector according to the invention.
Figure 7B:
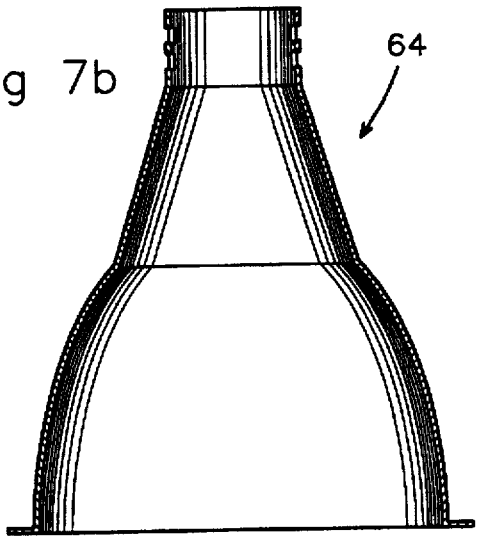
FIG. 7B is a section of the reflector of FIG. 7A taken along lines 7—7.

FIGS. 5A and B through FIGS. 8A and B illustrate respective reflectors 60, 62, 64 and 66, these reflectors having an optical geometry which is essentially identical in function to that of the reflector 12. The reflectors 60 through 66 as well as the reflector 12 are characterized by an optical geometry which is generated in essentially the same manner as will be described hereinafter. The reflectors 12, 60, 62, 64 and 66 are dimensioned differently due primarily to a choice of aperture diameter and due to the dimensions of a compact fluorescent lamp or other large-area light source which is to function within a given reflector. The reflectors of FIGS. 4 and 5 are intended for use with a tri-tube compact fluorescent lamp. The reflector 60 has a 5" aperture diameter, the aperture being the opening in the lowermost portion of the reflectors. The reflector 62 of FIG. 6 is intended for use with a compact fluorescent tri-tube lamp, the reflector having a 6.25" aperture or aperture diameter. The reflectors 64 and 66 of FIGS. 7 and 8 are intended for use with compact fluorescent 13 W/26 W Quad tube lamps with the respective reflectors having apertures of 7.9" and 6.25".

The reflector structures described above and shown in FIGS. 1 through 8 are generated by essentially identical methodology as will now be described relative to FIGS. 9 and 10. A reflector 68 is generated in FIG. 9 and is seen to be axially symmetrical as is common in downlighting. This axial symmetry is occasioned primarily due to aesthetic reasons but is also convenient in terms of manufacturing requirements. The axially symmetrical shape of the reflector 68 also forces the optical design process to be two dimensional in nature. In the present situation, a luminous source 70 which is practically taken to be a compact fluorescent lamp or similar large-area light source has a complex three-dimensional geometry such as would be encountered with a tri-tube lamp. This complex geometry must be reduced to a two-dimensional figure which represents the complex geometry of the lamp. The desired two-dimensional figure is best taken to be a vertical cross-section of the smallest axially symmetric form which would completely encompass the luminous source 70. Establishment of this axially symmetric form is essentially equivalent to establishing the surface of revolution which would result when revolving the luminous source 70 about its longitudinal axis and then taking a planar cross section which passes through the axis of revolution. One such resulting two-dimensional luminous source 70 is provided in outline in FIGS. 9 and 10 and provides fundamental optical reference points for establishment of the desired optical contours of the reflector 68. Luminous sources having axially symmetric geometries do not require establishment of a two-dimensional geometric form other than the simple establishment of an axial cross section.

Figure 9:
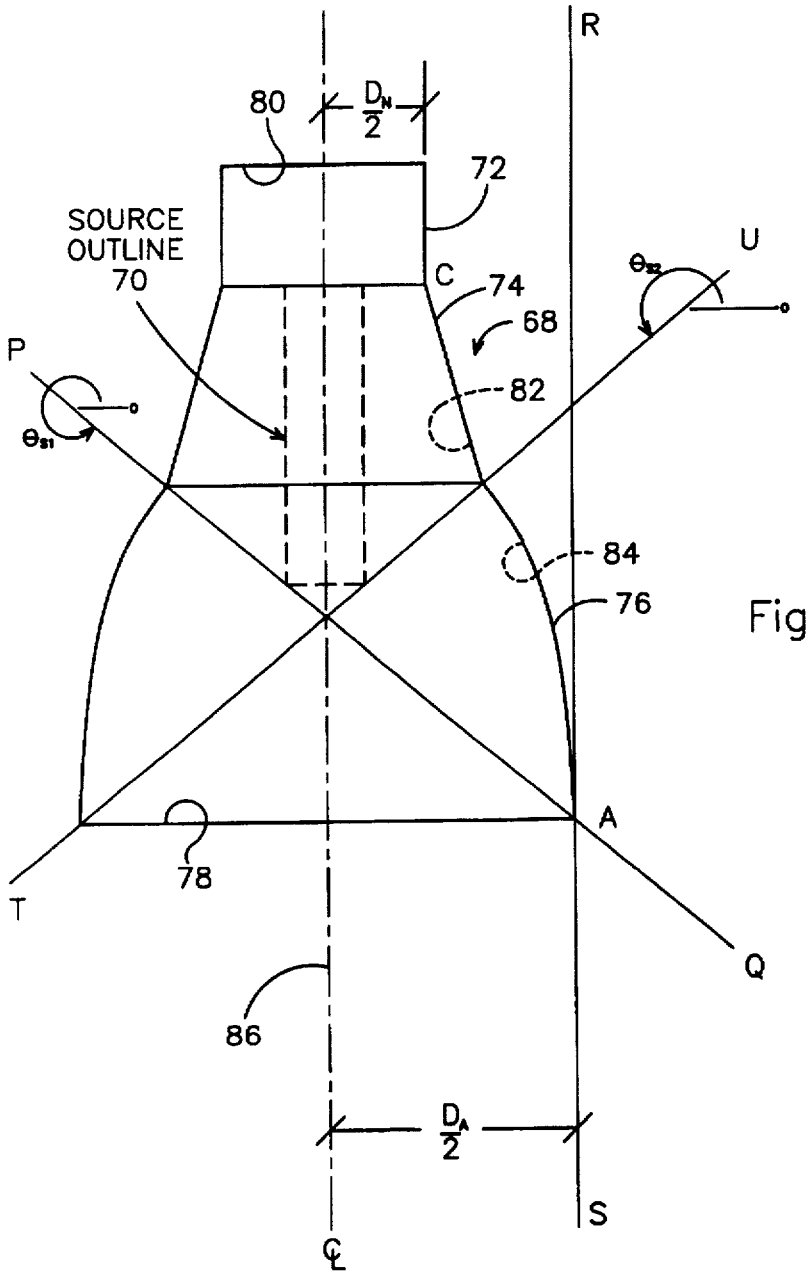
FIG. 9 is a diagram illustrating the manner by which the shape of the present downlight reflectors are generated.
Figure 10:
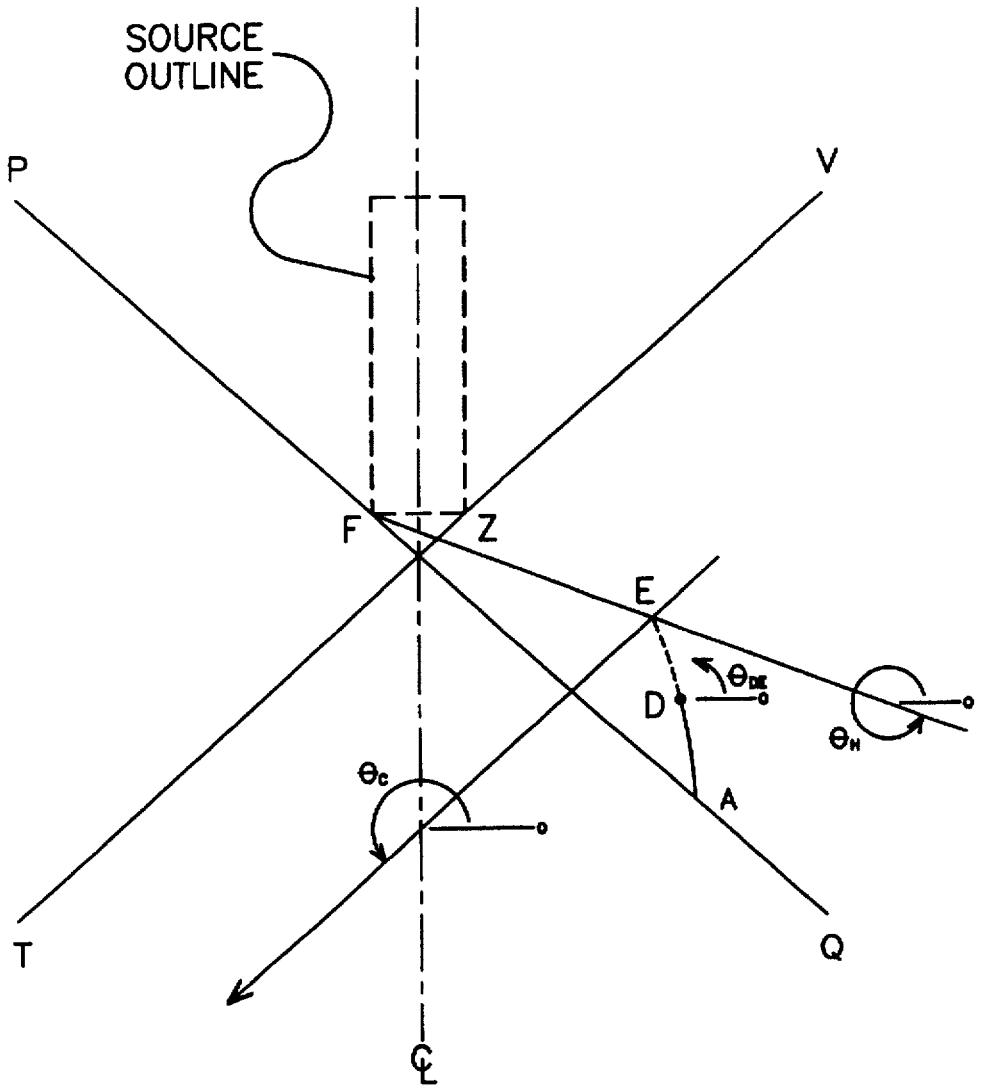
FIG. 10 is a diagram illustrating the manner by which each segment of the present downlight reflectors is generated.

In FIG. 9, the reflector 68 is seen to have a support section 72 which is cylindrical in form, a light concentration section 74 and a light distribution section 76, the outline of the sections 72, 74 and 76 being established as seen in FIG. 9, the diagrams of FIGS. 9 and 10 as explained by the following illustrating the manner by which the outline of the reflector 68 is produced. The reflector 68 has an opening 78 which terminates the light distribution section 76. The diameter of the opening 78 is taken to be the aperture diameter $D_A$. The diameter of opening 80 terminating the support section 72 is taken to be neck diameter $D_N$. In practical downlighting applications, the aperture diameter $D_A$ is typically 4 to 12" with the longer diameters usually being restricted to use with high intensity discharge light sources. The neck diameter $D_N$ is typically between 1 and 3". The aperture diameter $D_A$ in a downlighting application is seen at the ceiling line when a luminaire utilizing the reflector 68 is recessed in the ceiling (not shown).

The concept of a shield angle has been developed in relation to the brow of an observer, the shield angle referring to that angle, traditionally measured from horizontal, at which an observer can obtain a direct view of the luminous source 70 through the opening 78 which is otherwise known as the downlight aperture. Shield angle is simply measured positive downward from horizontal and equals θ. That value is converted to the coordinate system to be described to yield $\theta_{S1}$ and $\theta_{S2}$. The concept of a cutoff angle has its basis in reference to that angle, traditionally measured up from nadir, at which the light distribution section 76 begins to produce a reflected image of the luminous source 70. Thus the parameters necessary in addition to the outline of the luminous source 70 are as described.

Since the geometry of the support section 72 is primarily defined by the size and shape of the mechanical structure necessary to hold the luminous source 70 in place and permit adjustment, it is to be seen that the support section 72 plays no significant part in terms of the optical structure of the reflector 68 and is not a part of the optical design.

Construction of the optical contours of the reflector 68, that is, the shapes of internal reflective surfaces 82 and 84 respectively of the sections 74 and 76, is conveniently related to an appropriate coordinate system so that the shield angles and the cutoff angles can be converted to respective values within the coordinate system. A standard Cartesian coordinate system in X and Y proves convenient with angular quantities being referenced by a definition of the positive X axis direction as 0° with angles being measured positively in a counter-clockwise direction from that reference. Definition is thus provided of $\theta_{S1}$ and $\theta_{S2}$.

The optical contour of the reflector 68 comprises the internal reflective surfaces 82 of the light concentration section 74 as well as the internal reflective surfaces 84 of the light distribution section 76, these respective surfaces 82 and 84 having distinctly different function. The reflective surfaces 82 of the light concentration section 74 concentrates light efficiently into the light distribution section 76. The light distribution section 76 acts to provide an aesthetically pleasing appearance from typical viewing angles while also spreading light smoothly into a broad beam. In defining the optical contours of the reflector 68, a curve defining the internal reflective surfaces 84 of the light distribution section 76 is first constructed since the beginning point of the reflective surfaces 82 of the light concentration section 74 is the ending point of the light distribution section 76.

Definition of the curve AB is seen in FIG. 9 to begin with establishment of a vertical center line 86 upon which the outline of the luminous source 70 is centered in an orientation whereby the base of the luminous source 70 is essentially contained within the support section 72. A construction line PQ represents the shield angle of the luminous source 70 as approached from the right of the figure, the line PQ passing through the edge of the outline of the luminous source 70 and extending indefinitely in both directions such that the entire outline of the source 70 lies to the uppermost side of the line PQ. A second construction line RS is then drawn vertically at a distance of $D_A/2$ to the right of the center line, the intersection of the two constructions PQ and RS defining point A which is the location of the optic beginning point at the aperture of opening 78. A third construction line TU is drawn as the mirror image of line PQ about the center line 86 and represents the shield angle as the reflector 68 is approached from the left of the reflector. The angular region between lines PQ and TU to the right of the reflector 68 represents the angular extent of the optical contour in the light distribution section 76 of the reflector 68.

The optic beginning point A and the region of angular extent are thus established and are utilized with the outline of the luminous source 70 and the cutoff angle to develop the curve AB which defines the contour of the internal reflective surfaces 84 of the light distribution section 76. In order to avoid "flash", it is necessary to understand that the cutoff angle is that angle above which reflected rays are to be avoided. The angular region to the right of the reflector 68 between lines PQ and TU is divided into small, equal angular intervals and the contour of curve AB is developed piecewise by sequentially connecting line segments of the desired orientation across each of these angular intervals beginning at point A. The object of each sequential operation is the location of the next vertice based upon an incident ray and its desired direction of reflection. The direction of reflection is the cutoff angle for all cases, the angle of incidence varies linearly from the orientation of line PQ to that of line TU. A "bounding ray" is determined in each instance by determination of the line having the desired orientation dictated by the angle of incidence while passing tangent to the source outline of the source 70 such that the entire source outline lies to the uppermost side of the line. This "bounding ray" represents the limiting angle through which light coming direct from the luminous source 70 will be incident upon the optic segment and thus can be used to guarantee that no light will be directed above the cutoff angle.

It is to be seen in FIG. 9 that $\theta_{S1}$ represents the right side shield angle which is equal to 360° minus the conventional shield angle. $\theta_{S1}$ is taken to be between 325° and 315° given a conventional or typical shield angle of 35° to 45°. The left side shield angle, that is $\theta_{S2}$ is 180° plus the conventional shield angle which causes the value of $\theta_{S2}$ to be between 215° and 225° given the same assumption of a shield angle of 35° to 45°.

With reference to FIG. 10, a process for determining each sequential vertice is depicted graphically. For generality, a segment in the middle of the iterative operation is shown with realization that the initial iteration begins with the point A. A segment in the middle of the curve AB will have a bounding angle depending on the number of segments desired and the values $\theta_{S1}$ and $\theta_{S2}$ from FIG. 9. For the ith segment, these values are as follows:

$$\theta_H = \theta_{S1} + \frac{(\theta_{S2} - \theta_{S1} + 180)i}{n}$$

where:

i=the ith segment n=the total number of segments $\theta_H$=bounding angle of ith segment.

And, $\theta_C$=left side cutoff angle (217 to 227) and equals $\theta_{S2}$+2°.

A value other than 2° could be chosen. However, the 2° value is convenient and appropriate.

From these values, the orientation $\theta_{DE}$ of line segment DE is calculated as follows:

$$\theta_{DE} = \frac{\theta_H + \theta_C}{2} - 180$$

Lines FE and DE are converted into linear equations of the form Y=mX+b using known orientations and a single endpoint as follows:

For the line FE:

$m_{FE}$=tan ($\theta_H$)

$b_{FE}=F_y-m_{FE}{}^{F}x$

For the line DE:

$m_{DE}$=tan ($\theta_{DE}$)

$b_{DE}=D_y-m_{DE}{}^{Dx}$

Point E is thus established by solving the two linear equations in two unknowns as follows:

$$\text{For the } X \text{ component: } E_x = \frac{b_{FE} - b_{DE}}{m_{DE} - m_{FE}}$$

$$\text{For the } Y \text{ component: } E_y = m_{DE}E_x + b_{DE}$$

The foregoing process continues through the desired number of segments and finally terminates at some point on line TU which is taken to be point B. Thus the curve AB from which the internal reflective surfaces 84 of the light distribution section 76 is generated is thereby defined and a beginning point, that is, point B, for construction of the internal reflective surfaces 82 of the light concentration section 74 is thus established. Referring now again to FIG. 9, point C must be located in order to construct the line BC. The X component of point C will simply be that of the center line plus $D_N/2$ in order to obtain the desired neck diameter. The Y component of point C will be equivalent to the greatest Y component of the outline of the luminous source 70. Accordingly, the entire luminous area of the luminous source 70 lies below the support section 72 of the reflector 68. Line BC is thus defined and defines the internal reflective surfaces 82 of the light concentration section 74 by rotation about the center line 86.

It is to be understood that point F in FIG. 10 must be re-evaluated with each construction segment. In the case of a circular source outline, point F will move each time a point is determined.

It is further to be understood that an effective shield angle is generally taken to be between 35° and 45°. A shield angle of 35° or less produces glare since this angle is too much below the brow angle. A shield angle of 45° or greater results in poor efficiency. A shield angle of 40° is the most acceptable value. It is further to be understood that the angle between line BC and its mirror image is referred to as the divergence angle and is to be maximized to the degree possible since efficiency is higher in correspondence to greater values of the divergence angle. From a practical standpoint, the divergence angle of the light concentration section 74 must conform to a practical geometry of the support section 72 whereby the opening 80 has a reasonable diameter for mounting and housing purposes as have been described previously. Theoretically, the function of the light concentration section 74 would be increased by drawing of the line defining the section 74 directly to the outline of the luminous source 70 at its uppermost extent. In such a manner, the divergence angle would be greater. However, practicalities of manufacture, etc., prevent such construction.

Light produced by the luminous source 70 along the extent thereof from uppermost portions of said source 70 within the section 74 is reflected by the internal reflective surfaces 82 downwardly through the light concentration section 74 and effectively to the lowermost portion of the luminous source 70 whereby the light generated and concentrated within the light concentration section 74 is effectively perceived as emanating from the lowermost portion of the luminous source 70. Light produced along the luminous source 70 is therefore not wasted but is directed into the light distribution section 76 from which it is reflected by the internal reflective surfaces 84 of the section 76 outwardly of the opening 78 or aperture of the reflector 68 to produce a broad beam of light which is smoothly spread on surfaces thereby illuminated without the formation of bands and striations in the light beam. As should be understood, light is either directed out of the distribution section 76 or back into the luminous source 70 at a lower location, thereby increasing luminance near the tip of the source 70. While either situation is advantageous, the direction of the light out of the section 76 is preferred.

An aesthetically pleasing appearance is provided from typical viewing angles due to establishment of a favorable cutoff angle by the optical contour of the reflective surfaces 84 as defined herein. High angle glare and "flash"are thus eliminated even though the luminous source 70 is a large-area light source such as a compact fluorescent lamp. The structure of the reflector 68, as well as the structure of the reflectors 12 and 60 through 68, provide low aperture brightness at high angles with aperture appearance being similar to specification grade incandescent. The reflectors of the invention further produce a smooth single scallop on nearby vertical surfaces when recessed in a horizontal plane. Orientation of the luminous source 70, that is vertically, further allows optimum thermal efficiency. The fixtures employing the reflectors of the invention are compatible with both 26 W and 32 W lamping inter alia.

Figure 11:
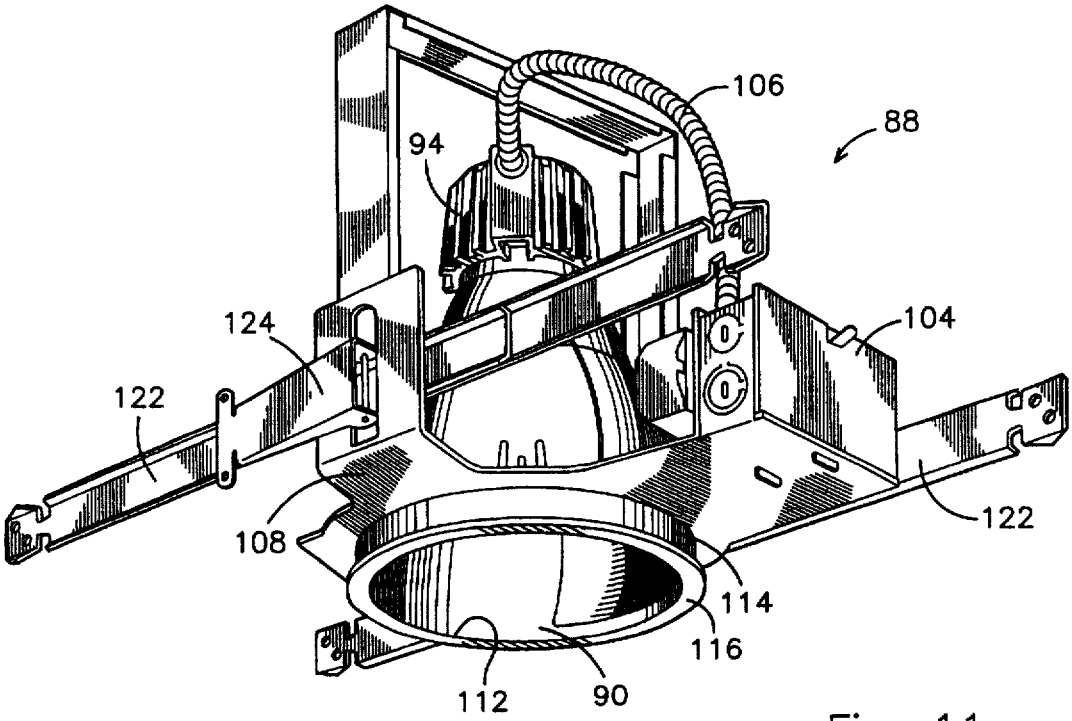
FIG. 11 is a perspective view of a lighting fixture utilizing a reflector intended for wall washing, the fixture being mounted in the ceiling of an environmental space.
Figure 12:
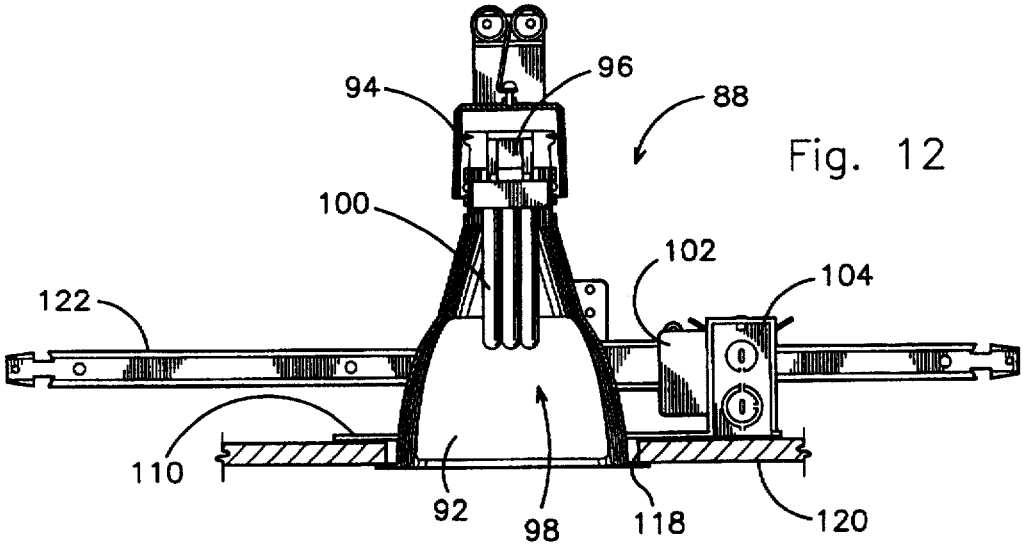
FIG. 12 is an idealized elevational view of the wall wash reflector structure seen generally in FIG. 11.

Referring now to FIGS. 11 and 12, a wall wash downlight fixture is seen generally at 88 to comprise a wall wash reflector 90 having a kicker reflector 92 mounted thereto. The reflector 90 has an opening 112 formed at its lower end. At its other end, the reflector 90 mounts a die-cast aluminum socket housing 94 within which is mounted a thermoplastic socket 96, the socket 96 being received into an upper portion of the reflector 90. A compact fluorescent lamp 98 is mounted in the socket 96, tubes 100 of the lamp 98 extending downwardly into the interior of the reflector 90. An electronic ballast 102, which can be a solid-state dimming ballast such as is manufactured by Lutron Electronics under the trademark Hi-Lume, drives the lamp 98 and is mounted to junction box 104, power being taken to the lamp 98 via conductors (not shown) within shield conduit 106. The structure thus described is carried by a mounting frame 108 which also is known as a pan, friction support springs (not shown) holding the reflector 90 within an opening in the frame 108. The opening is defined by a vertically extending flange 114, the reflector 90 being inserted into the opening from the underside thereof and engaging the friction support springs in a friction mount arrangement on full insertion of the reflector 90 into the opening. A flange 116 formed laterally of the reflector 90 abuts perimetric edges of the flange 114 on full insertion of the reflector 90 into the opening of the frame 108.

As is best seen in FIG. 12, the wall wash downlight fixture 88 is mounted above an opening 118 in ceiling 120 in a conventional manner. Mounting bars 122 essentially identical in structure and operation to the mounting bars 42 of FIGS. 1 and 2 act to mount the downlight fixture 88 to ceiling joists or to T-bar suspended ceiling structures. A locking mechanism 124 holds the relatively movable elements of the pairs of mounting bars 122 in a desired horizontal extension and vertical location so that the fixture 88 can be easily and readily mounted above the opening 118 in the ceiling 120.

The description given hereinabove relative to those structural components comprising the downlight fixture 10 are also seen to apply to those components forming the wall wash downlight fixture 88, this structure being conventional except for the structure of the wall wash reflector 90 and the kicker reflector 92 as will be hereinafter described.

As is best seen in FIGS. 13A and B, the wall wash reflector 90 is seen to be formed of a cylindrical lamp support section 126 which is essentially identical in structure and operation to the cylindrical lamp support section 46 of the reflector 12 as described relative to FIGS. 1 through 10 inter alia. The reflector 90 further comprises a light concentration section 128 and a light distribution section 130 which are constructed essentially according to the teachings provided hereinabove relative to the reflector 68 inter alia. Internal reflective surfaces 132 of the light concentration section 128 and internal reflective surfaces 134 of the light distribution section 130 are defined as described hereinabove relative to the reflector 68 inter alia. Still further, the lamp support section 126 is provided with respective pairs of upper slots 136 and lower slots 138 to facilitate mounting of the compact fluorescent lamp 98 (seen in FIG. 12) therewithin as described above relative to the slots 56, 58 of the reflector 12. The wall wash reflector 90 is formed substantially in the same manner as the reflector 12 or the reflector 68. The function and manner of forming the sections 126, 128 and 130 are essentially identical to corresponding structural portions of the reflector 12 and of the reflector 68 inter alia. The internal reflective surfaces 132 of the light concentration section and the internal reflective surfaces 134 of the light distribution section are formed in a manner essentially identical to the formation of the surfaces 82 and 84 of the reflector 68. The lamp support section 126 formed with pairs of the upper slots 136 and the lower slots 138 functions identically to the pairs of the slots 56 and 58 of the reflector 12.

As is particularly seen in FIGS. 13A and 13B, the reflector 90 is formed with a window 140 which is cut away from a portion of the light distribution section 130. Edges 142 and 144 of the window 140 subtend an angle of 118°, said edges 142 and 144 curving inwardly at upper and lower ends thereof to form radiused upper corners at 146 and 148 and radiused lower corners at 150 and 152. Lower edge 154 lies above opposing portions of the flange 116 at a distance of less than 2/10". Upper edge 156 of the window 140 lies along an intersecting circle at which the sections 128 and 130 join. The support section 126 is formed with apertures 158 located 90° apart and spaced from that circle defining the juncture of the support section 126 with the light concentration section 128, the apertures 158 being intended to receive rivets (not shown) for mounting the kicker reflector 92 to the wall wash reflector 90.

The optics of the reflector 90 are essentially identical to the optics of the reflector 12 inter alia except as modified for creation of the wall washing capability. The wall wash fixture 88 is intended to provide uniform vertical illumination on a nearby surface in one specific direction while maintaining an appearance equivalent to the appearance of the downlight fixture 10 from all other viewing angles. The downlight fixture 10 and the wall wash downlight fixture 88 will generally be used together with the wall wash downlight fixtures 88 being disposed on the periphery of a space being illuminated with the downlight fixtures 10 being disposed internally of the space in a known manner. The kicker reflector 92 provides a more suitable optical contour in spaced relation to the window 140 so that a vertical surface on the opposing side of the wall wash downlight fixture 88 is more appropriately illuminated.

Figure 19:
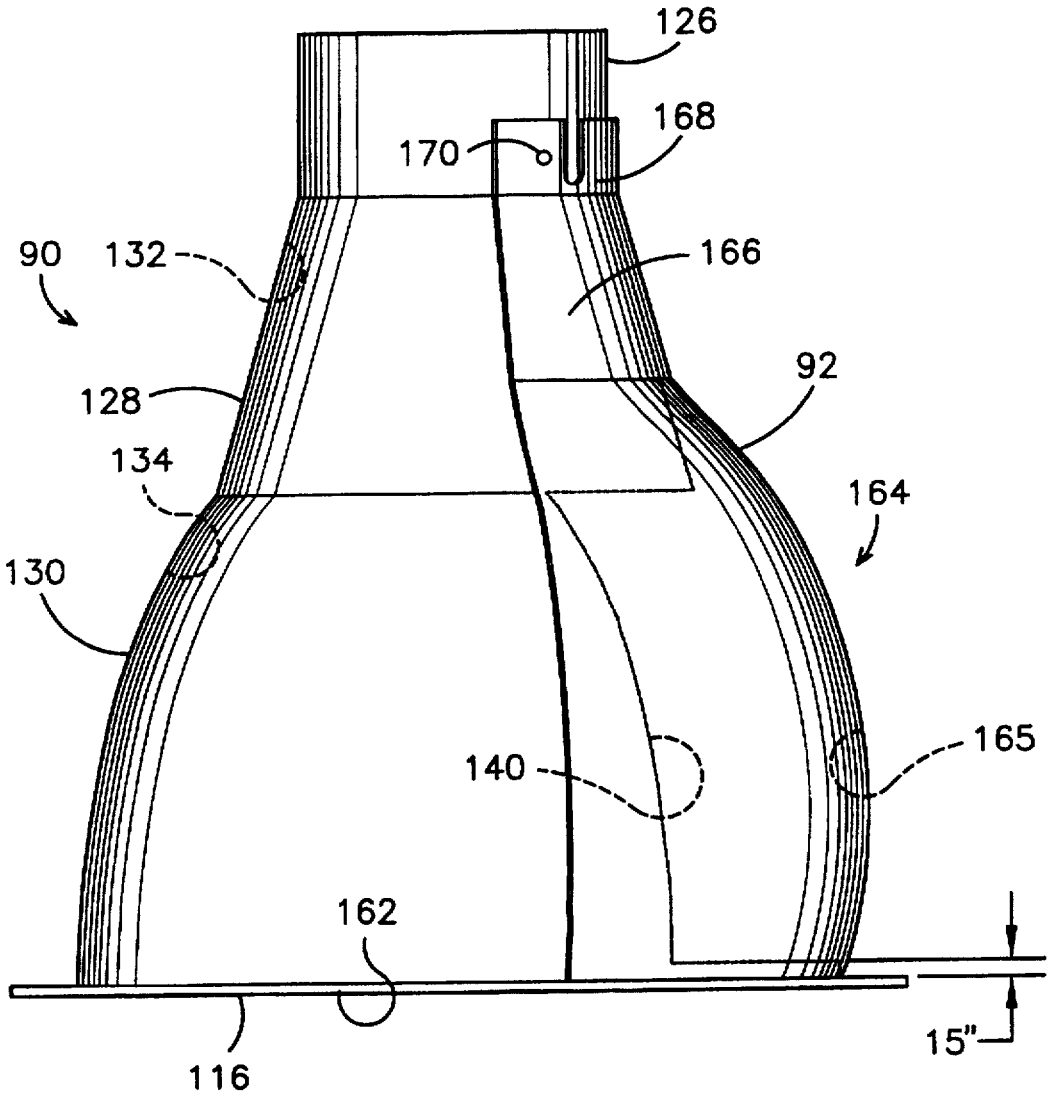
FIG. 19 is a side elevational view of a kicker reflector and a primary reflector body in combination according to the invention.

As seen in FIG. 19, reflective surfaces 165 of the kicker reflector 92 are intended to replace the optical contour at the location of the window 140, the ideal height of the window 140 would be identical to the height of the optical contour, that is, the reflective surfaces 134 of the light distribution section 130. However, it is necessary to leave a portion of the surfaces 134 immediately above the flange 116 as aforesaid in order to provide structural integrity to the reflector 90 both before and after mounting of the kicker reflector 92 thereto. As noted above, a material height at this location of less than 0.2" and preferably approximately 0.15" is maintained surmounting aperture or opening 162. The angular breadth of the window 140 is dimensioned so as to obtain broad coverage on a vertical surface when the fixture 88 is equally spaced parallel to the vertical surface without producing high angle brightness from typical viewing positions. The breadth of the kicker reflector 92 itself is chosen to be optimal at 150°, the kicker reflector 92 being centered over the window 140 to overlap the edges 142 and 144 by approximately 16° on each edge.

The optical contour of the reflective surfaces 165 of the kicker reflector 92 is similar to the optical contour of the reflective surfaces 134 of the light distribution section 130. The optical contour of the kicker reflector 92 is seen generally in FIG. 19 to comprise a reflective section having an optical contour shaping the reflective surfaces 165. An upper body section 166 joins to the reflective section 164, inner surfaces of the body section 166 lying against outer surfaces of the light concentration section 128. Attachment section 168 fits over a portion of the cylindrical lamp support section 126 and is provided with apertures 170 which align with the apertures 158 (not shown in FIG. 19) formed in the section 126, rivets or similar fasteners (not shown) being lockably inserted into the apertures 158 and 170 to hold the kicker reflector 92 to the wall wash reflector 90.

The optical contour of the kicker reflector 92 as embodied in the reflective surfaces 165 is similar to the optical contour of the light distribution section 130 of the wall wash reflector 90 as embodied in the internal reflective surfaces 134 in that the respective contours are axially symmetrical. However, the optical contour of the kicker reflector 92 does not extend through an entire 360° rotation. The lateral dimensions of the kicker reflector 92 simply need to extend beyond the window 140 azimuthally to the extent that no viewing position through the aperture or opening 162 can reveal plenum space above ceiling line. An azimuthal angle of 150° satisfies this aesthetic requirement.

Figure 14A:
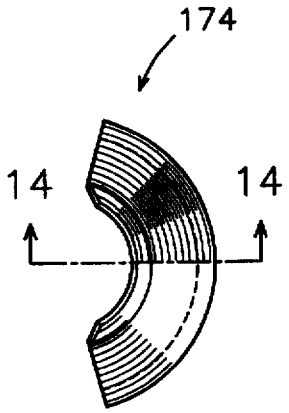
FIG. 14A is a plan view of a kicker reflector according to the invention.
Figure 14B:
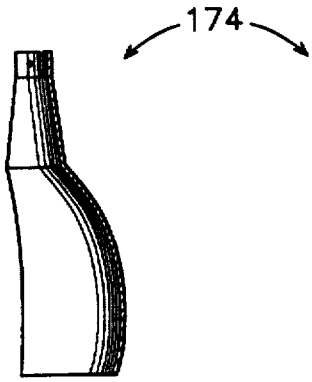
FIG. 14B is a section of the kicker reflector of FIG. 14A taken along line 14—14.
Figure 14C:
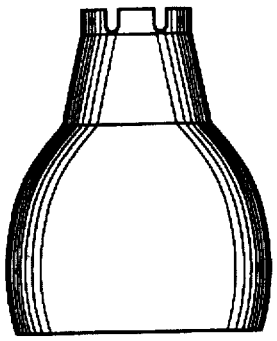
FIG. 14C is a side elevational view of the kicker reflector of FIG. 14A.

FIGS. 14 A, B and C illustrate a kicker reflector 174 which is intended for utilization with a wall wash reflector such as the reflector 90 designed for a tri-tube compact fluorescent light source and wherein the wall wash reflector has a 5" aperture.

Figure 15A:
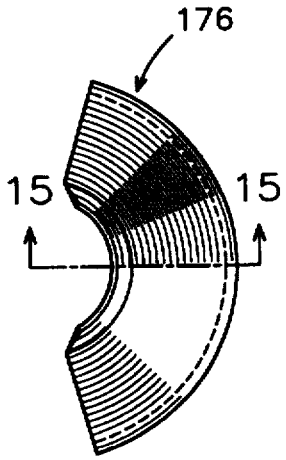
FIG. 15A is a plan view of another kicker reflector formed according to the invention.
Figure 15B:
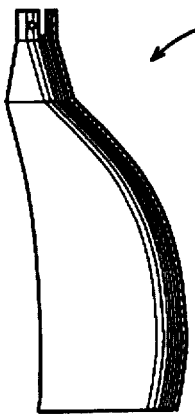
FIG. 15B is a section taken along line 15—15 of FIG. 15A.
Figure 15C:
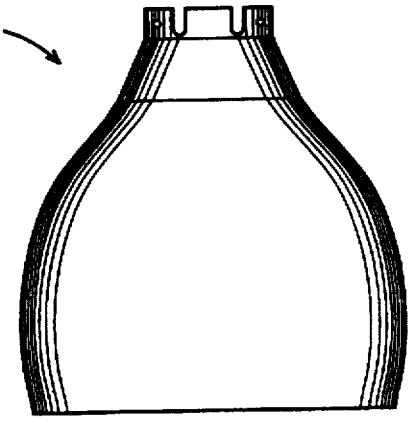
FIG. 15C is a side elevational view of the kicker reflector of FIG. 15A.

FIGS. 15A, B and C illustrate a kicker reflector 176 intended to be utilized with a wall wash reflector such as the reflector 90 having a tri-tube compact fluorescent light source (not shown) and with a 6" aperture.

Figure 16A:
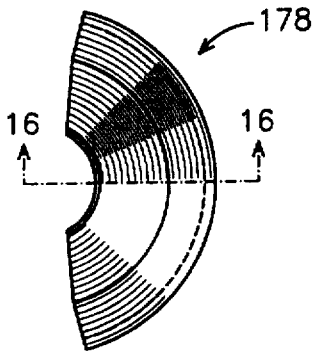
FIG. 16A is a plan view of yet another kicker reflector according to the invention.
Figure 16B:
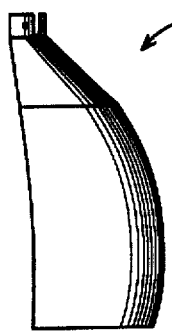
FIG. 16B is a section of the kicker reflector of the kicker reflector of FIG. 16A taken along lines 16—16.
Figure 16C:
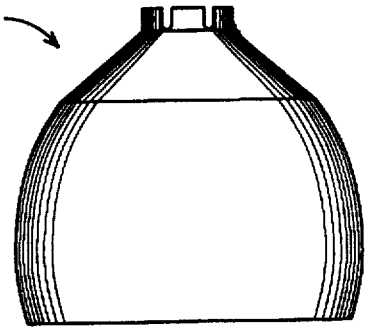
FIG. 16C is a side elevational view of the kicker reflector of FIG. 16A.

FIGS. 16A, B and C illustrate a kicker reflector 178 which is utilized with a wall wash reflector such as the reflector 90 utilizing a tri-tube compact fluorescent light source (not shown) with an aperture of 8".

Figure 17A:
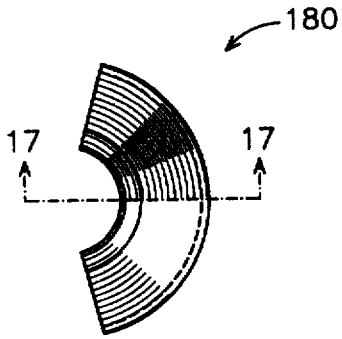
FIG. 17A is a plan view of another embodiment of the kicker reflector of the invention.
Figure 17B:
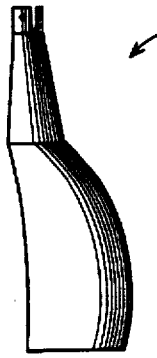
FIG. 17B is a section of the kicker reflector of FIG. 17A taken along lines 17—17.
Figure 17C:
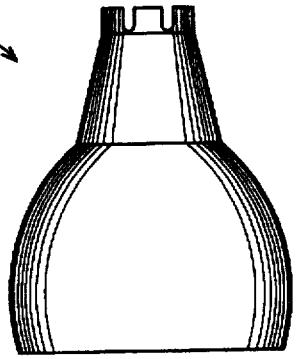
FIG. 17C is a side elevational view of the kicker reflector of FIG. 17A.

FIGS. 17A, B and C illustrate a kicker reflector 180 utilized with a wall wash reflector such as the reflector 90 and which is intended for use with a PL compact fluorescent light source (not shown) and with an aperture of 6".

Figure 18A:
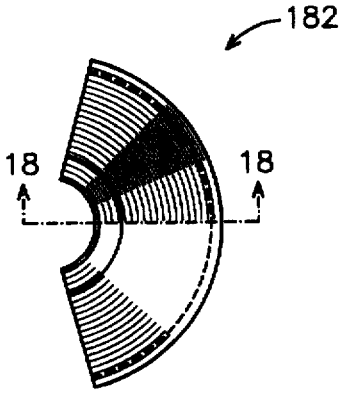
FIG. 18A is a plan view of a further embodiment of the kicker reflector of the invention.
Figure 18B:
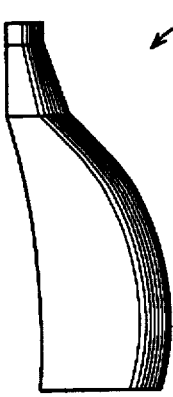
FIG. 18B is a section of the kicker reflector of FIG. 18A taken along lines 18—18.
Figure 18C:
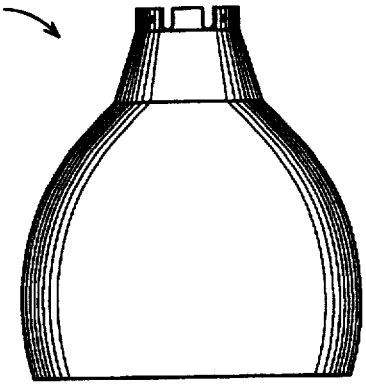
FIG. 18C is a side elevational view of the kicker reflector of FIG. 18A.

FIGS. 18A, B and C illustrate a kicker reflector 182 utilized with a wall wash reflector such as the reflector 90 and having a PL compact fluorescent source (not shown) and with an aperture of 8". FIGS. 14 through 18 thus illustrate varying geometries of kicker reflectors according to use with particular wall wash reflectors such as the wall wash reflector 90.

Figure 20:
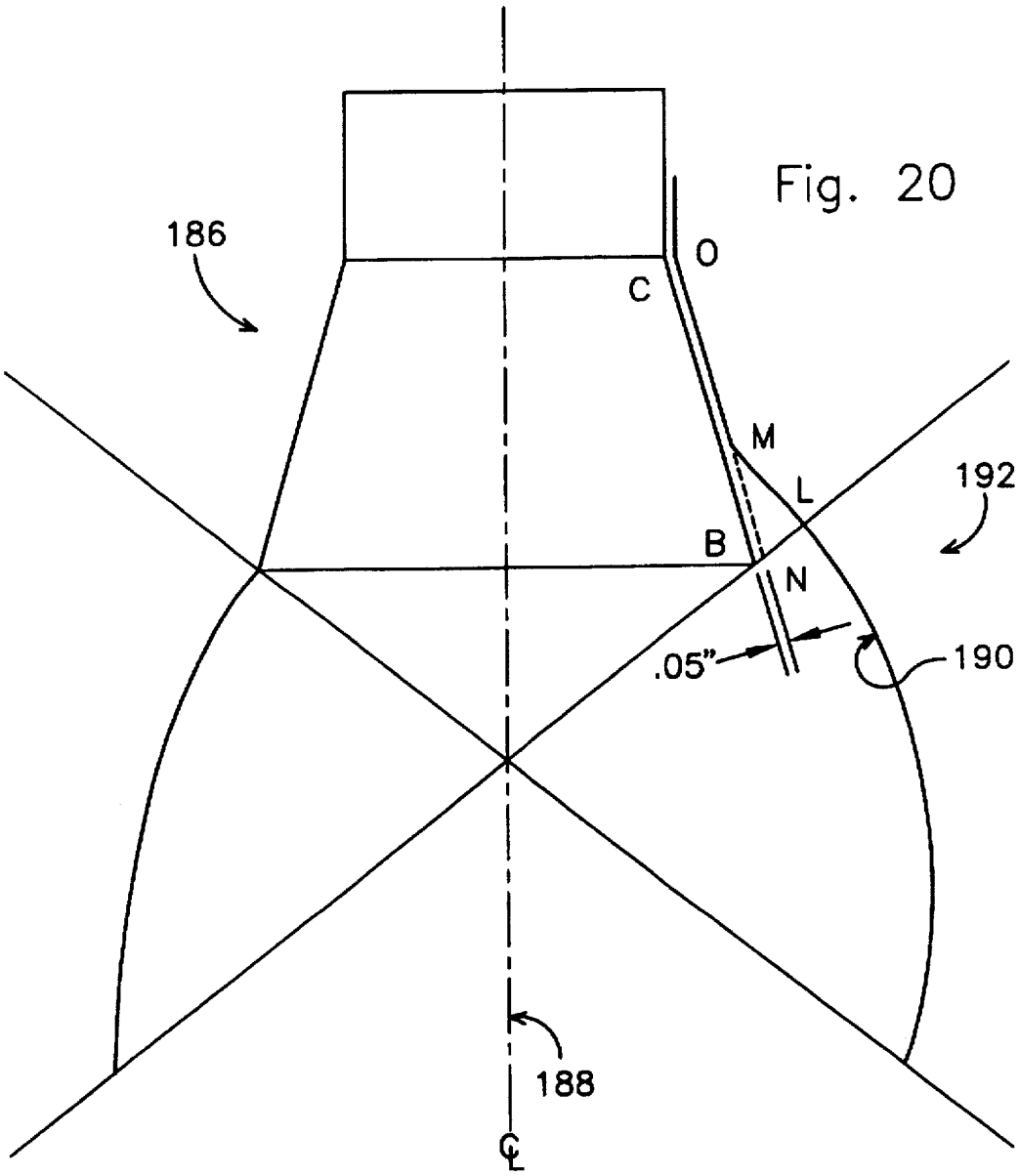
FIG. 20.is a diagram illustrating the generation of the shape of the kicker reflector.
Figure 21:
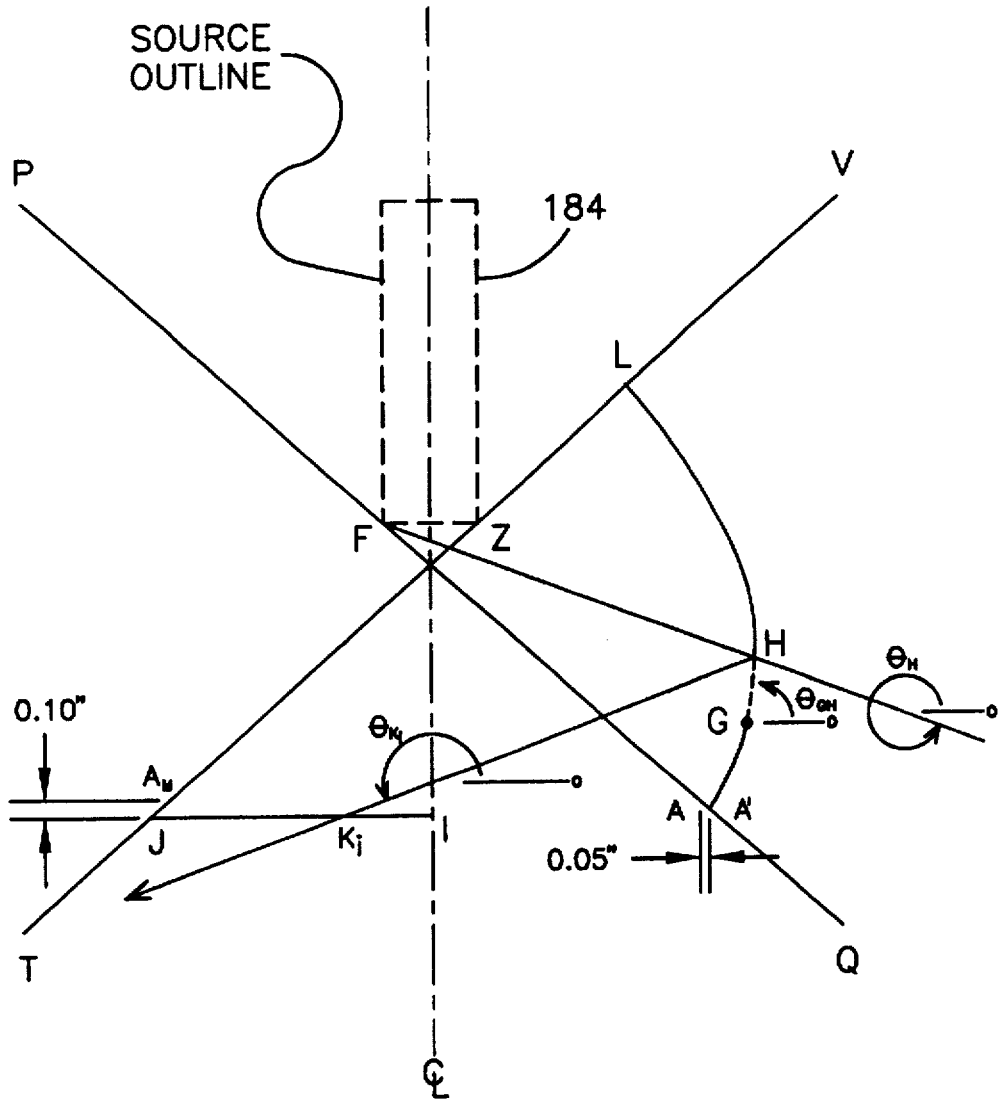
FIG. 21 is a diagram illustrating the manner by which each segment of the present kicker reflector is generated.

Referring now to FIGS. 20 and 21, the development of the optical contour of the various kicker reflectors such as the reflectors 92 and 174 through 182 is illustrated. In FIGS. 20 and 21, it can be seen that the optical contour of kicker reflector 192 is segmented in a similar manner with reference points on a chosen light source 184 being determined identically. However, a fundamental difference exists in that the optical contour of the downlight reflector 68 inter alia aims each bounding ray in a parallel fashion to the cutoff angle while the optical contour of the kicker reflector 192 aims each bounding ray sequentially to points along a line. This line begins at point I as seen in FIG. 21, point I being in the center of the aperture of downlight reflector 186 and on center line 188. The line beginning at point I extends to point J located approximately 0.1" directly below the left edge of the aperture $A_M$ as seen in FIG. 21. The amount of reflected light incident upon those portions of the downlight reflector 186 which oppose the kicker reflector 192 must be minimized since this light would then be reflected once again at a high angle producing unwanted brightness. It is also to be understood that precision optics are not feasible in downlighting environments due to tolerances in lamp manufacture and the limited scope of economically feasible lamp positioning mechanisms. Accordingly, line IJ is constructed at an oblique angle to allow for such tolerances, the vertical offset of approximately 0.1" being experimentally determined.

Referring back to the description presented relative to FIGS. 9 and 10, it is to be understood that the primary objective in the design of the optical contour of the reflective surfaces 84 of the light distribution section 76 was to produce no reflected light at an angle higher than the prescribed cutoff angle. Within those confines, the optical contour which produces the broadest distribution of light and the least distracting flash behavior is that contour which directs the bounding rays in a parallel fashion, that contour approximating a macrofocal parabola. The optical contour of the kicker reflector 192, however, is constructed such that a nearby vertical surface (not shown) opposite reflective surfaces 190 of the kicker reflector 192 will be illuminated as uniformly as possible and as high on the vertical surface as possible without directing light into the opposing optical contour represented by internal reflective surfaces such as the surfaces 134 of a light distribution section such as the section 130. If uniformity is temporarily not considered, it is seen that the optical contour in the vicinity of point A of FIG. 21 must be such that the bounding rays are directed nearly horizontally. In a like fashion, the reflective surfaces 190 of the kicker reflector 192 must be fully flashed at the shield angle in order to avoid striations in illuminance on the vertical surface by virtue of direct lamp luminance. The optical contour of the kicker reflector 192 must therefore direct the bounding rays near the shield angle at point L in FIG. 21. Accordingly, the optical contour of the reflective surfaces 190 of the kicker reflector 192 must sequentially direct the bounding rays at angles ranging from 180° to nearly $\theta_{S2}$ as constructed beginning at point A' through the angle $\theta_{S2}$+180°. Point A' is positioned 0.05" to the right of point A in order to allow for material thickness in the downlight reflector 186.

Boundary conditions are thus established as described above. With uniformity continuing to be removed as an issue, the rate at which kicker reflector 182 "flashes" becomes the remaining element in development of the optical contour of the kicker reflector 192. The kicker flash rate can be determined experimentally according to a variety of methods. For convenience, a linear path upon which the directed bounding rays are aimed is selected, this line being IJ wherein the point I is chosen for convenience. The point I could be any point having a direction relative to point A' of 180°. Tolerances as noted above are not considered due to the fact that the optical contour of the kicker reflector 192 is not actually revealed until a point less than 0.2" and preferably 0.15" about point A as noted in FIG. 19. Point J is selected such that the direction relative to point L is the shield angle plus some provision for tolerance. The optical contour of the kicker reflector 192 can then be developed in the same manner as the optical contour of the light distribution section 76 of the reflector 68 as described relative to FIGS. 9 and 10 with the exception that the direction of the reflected bounding ray varies with the angular position of a given segment relative to the incident bounding ray.

In order to derive the optical contours of the reflective surfaces 190 of the kicker reflector 192, second order expressions are developed and implemented to experimentally determine the best relationship between the position of the kicker reflector 192 relative to the incident bounding ray and the reflected direction along line IJ. For fluorescent sources, the relationship is linear. For light sources having different luminance distribution characteristics over surfaces of said sources, slightly different optimal relationships could be expected. Derivation of the optical contours of the reflective surfaces 190 would thus have identical mathematics to the derivation of the optical contours of the light distribution section 76 provided above except that the following relation is substituted for $\theta_C$:

$$\tan^{-1}\left[\frac{I_y + (J_y - I_y)\left(\frac{\theta_H - \theta_{S1}}{\theta_{S2} - \theta_{S1} + 180}\right)}{I_x + (J_x - I_x)\left(\frac{\theta_H - \theta_{S1}}{\theta_{S2} - \theta_{S1} + 180}\right)}\right]$$

The entire optical contour of the kicker reflector 192 is thereby detailed through point L and provides curve AL. Contours of the kicker reflector 192 above point L are mechanically dictated and essentially relate to a suitable geometrical description of the body section 166 and the attachment section 168 as described above relative to the kicker reflector 92. It is desirable to transition from point L to external surfaces of the downlight reflector 186 in a smooth manner accounting for reflector material thickness such that wrinkles are not encountered in the manufacturing process. Accordingly, the orientation of the last segment of the optical contour of the kicker reflector 192 is simply extended to an intersection point M which lies on line NO, the line NO being parallel to line BC as seen in FIG. 20. The line NO is offset for a material thickness of 0.5" to the rightmost side of line BC as seen in FIG. 20. The contour of the kicker reflector 192 then continues to point O as seen in FIG. 20 at which point the line may be extended vertically to serve mechanical functions as previously described relative to the attachment section 168 of the kicker reflector 92. In the event that the extended final segment does not intercept line NO, a straight line from point L to point O can be constructed.

It is to be understood that point F must be re-evaluated with each constructed segment. Point F would move to point Z once the kicker contour rises above point F, that is, once $\theta_H$ goes beyond 360°. In the case of a circular source outline, point F would move every time.

The reflective surfaces 190 of the kicker reflector 192 as well as the other kicker reflectors described hereinabove, are specular and are preferably formed of post anodized aluminum according to the Alzak process, Alzak being a registered trademark of Alcoa. The anodized aluminum coating which is essentially identical to the coating which produces the specular surface on optical contours of the downlight reflector 186 suppresses irridescence. The kicker reflector thus produced eliminates back flash and provides high light levels close to the ceiling line. In essence, a vertical surface or wall is effectively "washed" by the wall wash downlight fixture 88 particularly utilizing the wall wash reflector 90 and the kicker reflector 92 of the invention.

Figure 22:
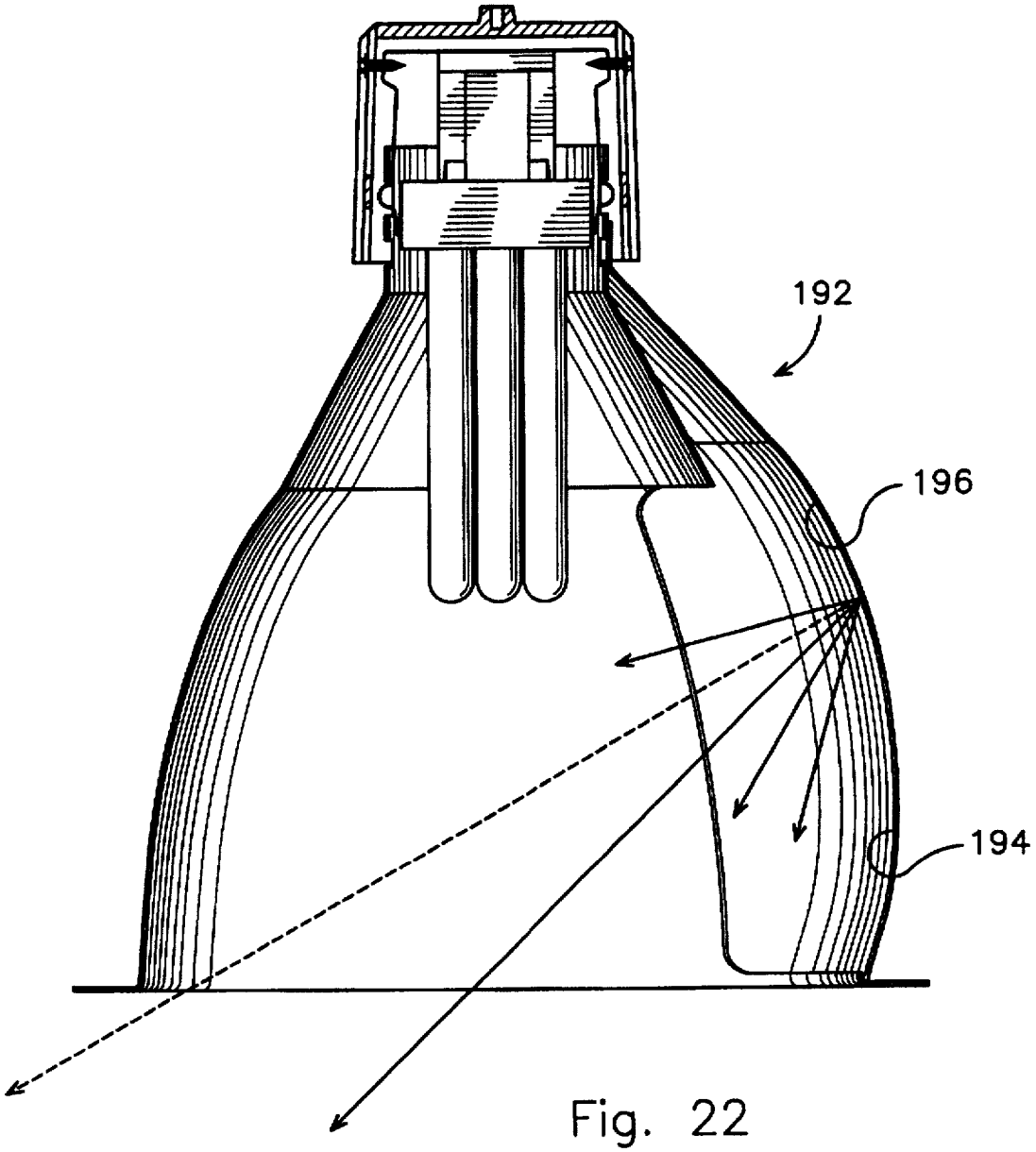
FIG. 22 is a diagram illustrating variation in the specularity of the reflective surfaces of the kicker reflector; and, FIG. 23 is an elevational view in section of the kicker reflector and primary reflector body in combination.

As is seen in FIG. 22, a kicker reflector 192 is provided with a specular zone 194 which essentially comprises the bottom ¾ of the optical contour of the kicker reflector 192, this zone 194 being highly polished. The specular quality of the specular zone 194 preferably feathers from the specular zone 194 to become semispecular above said zone 194 with a gradual transition to a diffuse zone 196 as the curve of the reflector 192 is followed upwardly from the lower edge of the reflector 192. It is to be understood that the diffuse zone 196 could also be referred to as a semispecular zone, it being of primary note that the optical character of the reflective portions of the kicker reflector 192 above the specular zone 194 becomes more diffuse in a gradual manner as distance from the specular zone 194 increases. It is to be understood that semi-specular reflection is taken to be reflection of a light beam in a number of directions from the point of incidence on a surface while specular reflection describes "mirror image" reflection of a light beam from a surface on which the light beam is incident.

As a practical matter, only a small area of transition between the specular zone 194 and the zone 196 is provided. Essentially, the zone 194 will be highly specular and the zone 196 will be semispecular or less specular than the zone 194. This two-zone provision with minimal transition between the two zones is necessitated by manufacturing considerations.

Figure 23:
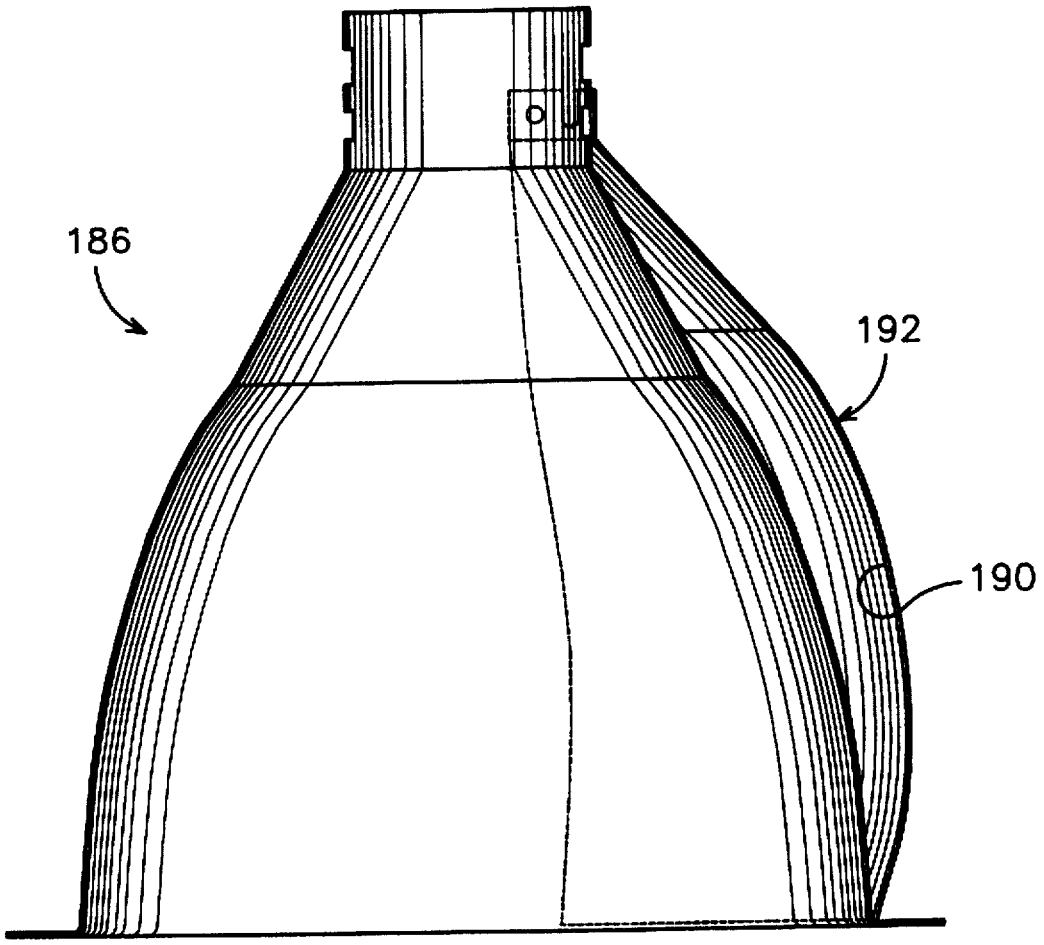

The kicker reflectors 192 of FIG. 22 and 23 also act to eliminate back flash and to provide high light levels close to the ceiling line. The kicker reflector 192 further provides exceptional uniformity on a vertical wall surface (not shown) opposite said reflector 192 due to the smoothing effect of the diffuse zone 196 of the kicker reflector 192.

While the invention has been described in terms of preferred embodiments thereof, it is to be understood that the invention can be practiced other than as specifically described above without departing from the scope of the invention as defined by the appended claims.

What is claimed is:

1. In a lighting fixture having a large-area light source and a cutoff angle, the improvement comprising a reflector having a light concentration section within which at least portions of the light source are located and a light distribution section optically joined to the light concentration section, light produced by the light source internally of the light concentration section being internally reflected therewithin to the light distribution section, the light distribution section directing light from an aperture thereof opposite the light concentration section to illuminate surfaces of an environmental space, the light distribution section having an optical contour generated by rotation about a center line of a curve defined by end points lying respectively on lines having an angle to the horizontal equal to shield angles approaching the reflector from opposite sides thereof, the lines each having an outline of the light source above said lines with the lines being tangential to said light source.

2. In the lighting fixture of claim 1 wherein the reflector further comprises means joined to the light concentration section for mounting a base of the light source and a socket mounting the base.

3. In the lighting fixture of claim 2 wherein the mounting means comprises a cylindrical lamp support section joined to the light concentration section at an end thereof opposite the light distribution section.

4. In the lighting fixture of claim 1 wherein the optical contour of the light concentration section is frustoconical in conformation.

5. In the lighting fixture of claim 1 wherein the light distribution section has an optical contour comprising at least portions of a macrofocal paraboloid.

6. In the lighting fixture of claim 1 wherein the reflector is formed with a window opening in a wall of the light distribution section and the improvement further comprises a kicker reflector carried by the reflector, portions of the kicker reflector being spaced from and being disposed in opposing relation to the window opening, the kicker reflector having light reflective surfaces formed in an optical contour opposing the window opening for reflecting light onto a vertical surface spaced from the fixture to wash the vertical surface with light.

7. In the lighting fixture of claim 6 wherein the optical contours of the light reflective surfaces of the kicker reflector aims each bounding ray incident thereon sequentially to points along a line defined by a point disposed centrally of an aperture of the reflector and by a point below and juxtaposed to an edge of the aperture opposite a given point on which the bounding ray is incident on the reflective surfaces of the kicker reflector.

8. In the lighting fixture of claim 7 wherein the point below and juxtaposed to the edge of the aperture is spaced 0.1 inch below the edge of the aperture.

9. In the lighting fixture of claim 6 wherein the lowermost portions of the light reflective surfaces of the kicker reflector are formed with high specularity relative to remaining portions of the reflective surfaces.

10. In the lighting fixture of claim 9 wherein at least major portions of the remaining portions of the reflective surfaces are relatively semispecular.

11. In the lighting fixture of claim 10 wherein a portion of the light reflective surfaces of the kicker reflector between the highly specular lowermost portions and the diffuse portions thereof gradually decrease in specularity from said lowermost portions to the diffuse portions.

12. In the lighting fixture of claim 9 wherein the highly specular lowermost portions comprise a zone three-quarter inch in width along a bottom edge of the kicker reflector.

13. In the lighting fixture of claim 1 wherein the light source comprises a compact fluorescent lamp or other large area source.

14. In the lighting fixture of claim 13 wherein the lighting fixture is a downlighting fixture and the compact fluorescent lamp is oriented vertically along the longitudinal axis thereof.

15. In the lighting fixture of claim 1 wherein at least major portions of the light source are located within the light concentration section.

16. In a lighting fixture having a large-area light source and a cutoff angle, the improvement comprising a reflector having a light concentration section within which at least portions of the light source are located and a light distribution section optically joined to the light concentration section, light produced by the light source internally of the light concentration section being internally reflected therewithin to the light distribution section, the light distribution section directing light from an aperture thereof opposite the light concentration section to illuminate surfaces of an environmental space, the light distribution section having an optical contour generated by rotation about a center line of a curve producing at least portions of a macrofocal paraboloid.

17. In the lighting fixture of claim 16 wherein the optical contour of the light concentration section is frustoconical in conformation.

18. In the lighting fixture of claim 16 wherein the reflector is formed with a window opening in a wall of the light distribution section and the improvement further comprises a kicker reflector carried by the reflector, portions of the kicker reflector being spaced from and being disposed in opposing relation to the window opening, the kicker reflector having light reflective surfaces formed in an optical contour opposing the window opening for reflecting light onto a vertical surface spaced from the fixture to wash the vertical surface with light.

19. In the lighting fixture of claim 18 wherein the optical contours of the light reflective surfaces of the kicker reflector aims each bounding ray incident thereon sequentially to points along a ling defined by a point disposed centrally of an aperture of the reflector and by a point below and juxtaposed to an edge of the aperture opposite a given point on which the bounding ray is incident on the reflective surfaces of the kicker reflector.

20. In the lighting fixture of claim 14 wherein the point below and juxtaposed to the edge of the aperture is spaced 0.1 inch below the edges of the aperture.

21. In the lighting fixture of claim 18 wherein the lowermost portions of the light reflective surfaces of the kicker reflector are formed with high specularity relative to remaining portions of the reflector surfaces.

22. In the lighting fixture of claim 21 wherein at least major portions of the remaining portions of the reflective surfaces are relatively semispecular.

23. In the lighting fixture of claim 22 wherein a portion of the light reflective surfaces of the kicker reflector between the highly specular lowermost portions and the diffuse portions thereof gradually decrease in specularity from said lowermost portions to the diffuse portions.

24. In the lighting fixture of claim 21 wherein the highly specular lowermost portions comprise a zone approximately ¾ inch in width along a bottom edge of the kicker reflector.

25. In the lighting fixture of claim 16 wherein the light source comprises a compact fluorescent lamp or other large area source.

26. In the lighting fixture of claim 25 wherein the lighting fixture is a downlighting fixture and the compact fluorescent lamp is oriented vertically along the longitudinal axis thereof.

27. In the lighting fixture of claim 16 wherein at least major portions of the light source are located within the light concentration section.

28. In a lighting fixture having a large-area light source and a cutoff angle, the improvement comprising a reflector having a light concentration section within which at least portions of the light source are located and a light distribution section optically joined to the light concentration section, the light distribution section having an optical contour generated by rotation about a center line of a curve defined by end points lying respectively on lines having an angle to the horizontal equal to shield angles approaching the reflector from opposite sides thereof, the lines each having an outline of the light source above said lines with the lines being tangential to said light source, light produced by the light source internally of the light concentration section being internally reflected therewithin to the light distribution section, the light distribution section directing light from an aperture thereof opposite the light concentration section to illuminate surfaces of an environmental space, the light concentration section having an optical contour which is frustoconical in conformation.

29. In the lighting fixture of claim 28 wherein the light distribution section has an optical contour generated by rotation about a center line of a curve defined by end points lying respectively on lines having an angle to the horizontal equal to shield angles approaching the reflector from opposite sides thereof, the lines each having an outline of the light source above said lines with the lines being tangential to said light source, the curve between the end points being derived by sequentially connecting line segments of infinitely small lengths, each line segment reflecting an incident ray of light in a direction equal to the cutoff angle defined by said lines, the angle of incidence of the ray of light being the greatest angle which intercepts the outline of the light source, an ith segment having a bounding angle dependent upon a desired number of segments and values of a right side shield angle $\theta_{S1}$ and a left side shield angle $\theta_{S2}$, $\theta_{S1}$ being 360° minus a conventional shield angle between 35° and 45° and $\theta_{S2}$ being 180° plus the conventional shield angle, values of a bounding angle of the ith segment being $\theta_H$ and wherein $$\theta_H = \theta_{S1} + \frac{(\theta_{S2} - \theta_{S1} + 180)i}{n}$$

where i=the ith segment n=the total number of segments in the curve, orientation of the ith segment then being determined by $$\theta_i = \frac{\theta_H + \theta_C}{2} - 180$$

wherein $\theta_C$=left side cutoff angle=$\theta_{S2}$+2° and wherein a line along the bounding angle and the line segment is defined by Y=mX+b and wherein the line along the bounding angle is m=tan($\theta_H$) and b is equal to a Y coordinate of a point at which the line along the bounding angle intercepts the outline of the light source minus the product of the slope of the line along the bounding angle and the X coordinate of the point at which the line along the bounding angle intercepts the outline of the light source, and wherein the ith segment has a slope equal to the tangent of $\theta_{DE}$ where $$\theta_{DE} = \frac{\theta_H + \theta_C}{2} - 180$$

and wherein b is equal to the Y coordinate of a lower end point of the ith segment minus the product of the slope of the ith segment and the X coordinate of the lower end point of the ith segment, the ith segment being established as a point on the curve having an X component equal to the b value of the line along the bounding angle minus the b value of the ith segment divided by the slope of the ith segment minus the slope of the line along the bounding angle, the curve having a Y component equal to the slope of the ith segment times the X component plus the b value of the ith segment, each of the n number of the ith segments being so defined to generate the curve.

30. In the lighting fixture of claim 28 wherein the base of the light concentration section is coincident with perimetric upper portions of the light distribution section.

31. In the lighting fixture of claim 28 wherein rotation of the curve produces at least portions of a macrofocal paraboloid.

32. In the lighting fixture of claim 28 wherein the reflector is formed with a window opening in a wall of the light distribution section and the improvement further comprises a kicker reflector carried by the reflector, portions of the kicker reflector being spaced from and being disposed in opposing relation to the window opening, the kicker reflector having light reflective surfaces formed in an optical contour opposing the window opening for reflecting light onto a vertical surface spaced from the fixture to wash the vertical surface with light.

33. In the lighting fixture of claim 32 wherein the optical contours of the light reflective surfaces of the kicker reflector aims each bounding ray incident thereon sequentially to points along a line defined by a point disposed centrally of an aperture of the reflector and by a point below and juxtaposed to an edge of the aperture opposite a given point on which the bounding ray is incident on the reflective surfaces of the kicker reflector.

34. In the lighting fixture of claim 28 wherein at least major portions of the light source are located within the light concentration section.

35. In a lighting fixture having a large-area light source and a cutoff angle, the improvement comprising a reflector having a light concentration section within which at least portions of the light source are located and a light distribution section optically joined to the light concentration section, light produced by the light source internally of the light concentration section being internally reflected therewithin to the light distribution section, the light distribution section directing light from an aperture thereof opposite the light concentration section to illuminate surfaces of an environmental space, the light distribution section having internal reflective surfaces which have an optical contour defined by rotation of a curve about a center line of the reflector, each point on the curve aiming each bounding ray incident thereon parallel to the cutoff angle of the reflector.

36. In the lighting fixture of claim 35 wherein the optical contour of the internal reflective surfaces of the light distribution section comprises at least portions of a macrofocal paraboloid.

37. In the lighting fixture of claim 36 wherein the optical contour of the light concentration section is frustoconical in conformation.

38. In the lighting fixture of claim 35 wherein the optical contour of the light concentration section is frustoconical in conformation.

39. In the lighting fixture of claim 35 wherein the light distribution section has an optical contour generated by rotation about a center line of a curve defined by end points lying respectively on lines having an angle to the horizontal equal to shield angles approaching the reflector from opposite sides thereof, the lines each having an outline of the light source above said lines with the lines being tangential to said light source.

40. In the lighting fixture of claim 39 wherein rotation of the curve produces at least portions of a macrofocal paraboloid.

41. In a lighting fixture having a large-area light source and a reflector having a cutoff angle, the improvement comprising:

first means comprising a portion of the reflector and defining a light distribution section thereof for directing light from an aperture thereof, the light distribution section having an optical contour generated by rotation about a center line of a curve defined by and points lying respectively on lines having an angle to the horizontal equal to shield angles approaching the reflector from opposite sides thereof, the lines each having an outline of the light source above said lines with the lines being tangential to said light source; and, second means comprising a portion of the reflector and defining a light concentration section which is optically joined to the light distribution section to form an optical juncture therebetween, at least portions of the light source being located within the light concentration section, for internally reflecting light produced by the light source internally of the light concentration section to concentrate said light and to direct the internally reflected and concentrated light progressively toward and past the optical juncture of the light concentration section and the light distribution section, the light so concentrated and directed into the light distribution section being directed from the aperture which is located opposite the light concentration section to illuminate surfaces of an environmental space.

42. In the lighting fixture of claim 41 wherein the light distribution section has an optical contour comprising at least portions of a macrofocal paraboloid.

43. In the lighting fixture of claim 42 wherein the optical contour of the light concentration section is frustoconical in conformation.

44. In the lighting fixture of claim 41 wherein the optical contour of the light concentration section is frustoconical in conformation.

45. In the lighting fixture of claim 41 wherein rotation of the curve produces at least portions of a macrofocal paraboloid.

46. In a lighting fixture having a large-area light source and a cutoff angle, the improvement comprising a reflector having a light concentration section within which at least portions of the light source are located and a light distribution section optically joined to the light concentration section, light produced by the light source internally of the light concentration section being internally reflected therewithin to the light distribution section, the light distribution section directing light from an aperture thereof opposite the light concentration section to illuminate surfaces of an environmental space, the reflector being formed with a window opening in a wall of the light distribution section, the improvement further comprising a kicker reflector carried by the reflector, portions of the kicker reflector being spaced from and being disposed in opposing relation to the window opening, the kicker reflector having light reflective surfaces formed in an optical contour opposing the window opening for reflecting light onto a vertical surface spaced from the fixture to wash the vertical surface with light, the optical contours of the light reflective surfaces of the kicker reflector aiming each bounding ray incident thereon sequentially to points along a line defined by a point disposed centrally of an aperture of the reflector and by a point below and juxtaposed to an edge of the aperture opposite a given point on which the bounding ray is incident on the reflective surfaces of the kicker reflector.

47. In the lighting fixture of claim 46 wherein the optical contour of the light concentration section is frustoconical in conformation.

48. In the lighting fixture of claim 46 wherein the light distribution section has an optical contour generated by rotation about a center line of a curve defined by end points lying respectively on lines having an angle to the horizontal equal to shield angles approaching the reflector from opposite sides thereof, the lines each having an outline of the light source above said lines with the lines being tangential to said light source.

49. In the lighting fixture of claim 48 wherein rotation of the curve produces at least portions of a macrofocal paraboloid.

50. In the lighting fixture of claim 49 wherein the optical contour of the light concentration section is frustoconical in conformation.

51. In the lighting fixture of claim 48 wherein the optical contour of the light concentration section is frustoconical in conformation.

52. In the lighting fixture of claim 46 wherein the point below and juxtaposed to the edge of the aperture is spaced 0.1" below the edge of the aperture.

53. In the lighting fixture of claim 46 wherein the lowermost portions of the light reflective surfaces of the kicker reflector are formed with high specularity relative to remaining portions of the reflective surfaces.

54. In the lighting fixture of claim 53 wherein at least major portions of the remaining portions of the reflective surfaces are relatively semispecular.

55. In the lighting fixture of claim 54 wherein a portion of the light reflective surfaces of the kicker reflector between the highly specular lowermost portions and the diffuse portions thereof gradually decrease in specularity from said lowermost portions to the diffuse portions.

56. In the lighting fixture of claim 53 wherein the highly specular lowermost portions comprise a zone ¾" in width along a bottom edge of the kicker reflector.

57. In the lighting fixture of claim 46 wherein the light source comprises a compact fluorescent lamp or other large area source.

58. In the lighting fixture of claim 57 wherein the lighting fixture is a downlighting fixture and the compact fluorescent lamp is oriented vertically along the longitudinal axis thereof.

59. In a lighting fixture having a large-area light source and a cutoff angle, the improvement comprising a reflector having a light concentration section within which at least portions of the light source are located and a light distribution section optically joined to the light concentration section, light produced by the light source internally of the light concentration section being internally reflected therewithin to the light distribution section, the light distribution section directing light from an aperture thereof opposite the light concentration section to illuminate surfaces of an environmental space, the light distribution section having an optical contour generated by rotation about a center line of a curve defined by end points lying respectively on lines having an angle to the horizontal equal to shield angles approaching the reflector from opposite sides thereof, the lines each having an outline of the light source above said lines with the lines being tangential to said light source, the curve between the end points being derived by sequentially connecting line segments of infinitely small lengths, each line segment reflecting an incident ray of light in a direction equal to the cutoff angle defined by said lines, the angle of incidence of the ray of light being the greatest angle which intercepts the outline of the light source, any ith segment having a bounding angle dependent upon a desired number of segments and values of a right side shield angle $\theta_{S1}$ and a left side shield angle $\theta_{S2}$, $\theta_{S1}$ being 360° minus a conventional shield angle between 35° and 45° and $\theta_{S2}$ being 180° plus the conventional shield angle, values of a bounding angle of the ith segment being $\theta_H$ and wherein $$\theta_H = \theta_{S1} + \frac{(\theta_{S2} - \theta_{S1} + 180)i}{n}$$

where i=the ith segment n=the total number of segments in the curve, orientation of the ith segment then being determined by $$\theta_i = \frac{\theta_H + \theta_C}{2} - 180$$

wherein $\theta_C$=left side cutoff angle=$\theta_{S2}$+2° and wherein a line along the bounding angle and the line segment is defined by Y=mX+b and wherein the line along the bounding angle is m=tan($\theta_H$) and b is equal to a Y coordinate of a point at which the line along the bounding angle intercepts the outline of the light source minus the product of the slope of the line along the bounding angle and the X coordinate of the point at which the line along the bounding angle intercepts the outline of the light source, and wherein the ith segment has a slope equal to the tangent of $\theta_{DE}$ where $$\theta_{DE} = \frac{\theta_H + \theta_C}{2} - 180$$

and wherein b is equal to the Y coordinate of a lower end point of the ith segment minus the product of the slope of the ith segment and the X coordinate of the lower end point of the ith segment, the ith segment being established as a point on the curve having an X component equal to the b value of the line along the bounding angle minus the b value of the ith segment divided by the slope of the ith segment minus the slope of the line along the bounding angle, the curve having a Y component equal to the slope of the ith segment times the X component plus the b value of the ith segment, each of the n number of the ith segments being so defined to generate the curve.

60. In the lighting fixture of claim 59 wherein the optical contour of the light concentration section is frustoconical in conformation.

61. In the lighting fixture of claim 60 wherein the light source comprises a compact fluorescent lamp or other large area sources.

62. In the lighting fixture of claim 59 wherein the light source comprises a compact fluorescent lamp or other large area source.

63. In the lighting fixture of claim 62 wherein the lighting fixture is a downlighting fixture and the compact fluorescent lamp is oriented vertically along the longitudinal axis thereof.

64. In a lighting fixture having a large-area light source and a cutoff angle, the improvement comprising a reflector having a light concentration section within which at least portions of the light source are located and a light distribution section optically joined to the light concentration section, light produced by the light source internally of the light concentration section being internally reflected therewithin to the light distribution section, the light distribution section directing light from an aperture thereof opposite the light concentration section to illuminate surfaces of an environmental space, the light concentration section having an optical contour which is frustoconical in conformation, the reflector being formed with a window opening in a wall of the light distribution section and the improvement further comprising a kicker reflector carried by the reflector, portions of the kicker reflector being spaced from and being disposed in opposing relation to the window opening, the kicker reflector having light reflective surfaces formed in an optical contour opposing the window opening for reflecting light onto a vertical surface spaced from the fixture to wash the vertical surface with light, the optical contour of the light reflective surfaces of the kicker reflector aiming each bounding ray incident thereof sequentially to points along a line defined by a point disposed centrally of an aperture of the reflector and by a point below and juxtaposed to an edge of the aperture opposite a given point on which the bounding ray is incident on the reflective surfaces of the kicker reflector.

* * * * *